US010947787B2

(12) United States Patent
Fuller et al.

(10) Patent No.: US 10,947,787 B2
(45) **Date of Patent: *Mar. 16, 2021**

(54) UNDERREAMER FOR INCREASING A WELLBORE DIAMETER

(71) Applicant: Smith International, Inc., Houston, TX (US)

(72) Inventors: Nathan E. Fuller, Spring, TX (US); Jonathan D. Marshall, Springville, UT (US); Jordan D. Englund, Provo, UT (US); Jacques Orban, Katy, TX (US); R. Craig Boswell, Draper, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 66 days.

This patent is subject to a terminal disclaimer.

(21) Appl. No.: 16/244,221

(22) Filed: Jan. 10, 2019

(65) Prior Publication Data

US 2019/0145178 A1 May 16, 2019

Related U.S. Application Data

(63) Continuation of application No. 15/379,690, filed on Dec. 15, 2016, now Pat. No. 10,190,368, which is a (Continued)

(51) Int. Cl.
*E21B 10/32* (2006.01)
*E21B 44/00* (2006.01)
(Continued)

(52) U.S. Cl.
CPC ..... *E21B 10/322* (2013.01); *E21B 7/128* (2013.01); *E21B 34/066* (2013.01); *E21B 44/00* (2013.01);
(Continued)

(58) Field of Classification Search
CPC ..... E21B 7/28; E21B 10/322; E21B 10/345; E21B 44/06; E21B 44/00; E21B 34/066
See application file for complete search history.

(56) References Cited

U.S. PATENT DOCUMENTS 2,894,590 A 7/1959 Johnson
3,053,087 A 9/1962 Waugh
(Continued)

FOREIGN PATENT DOCUMENTS

GB 2102129 A 1/1983
GB 2460096 A 11/2009
(Continued)

OTHER PUBLICATIONS

International Search Report and Written Opinion issued in International Patent Application No. PCT/US2014/027634, dated Aug. 14, 2014, 17 pages.
(Continued)

*Primary Examiner* — Jennifer H Gay

(57) ABSTRACT

An underreamer for increasing a diameter of a wellbore. The underreamer may include a body having an axial bore extending at least partially therethrough. An electromagnetic activation system may be disposed at least partially within the bore of the body. A valve may be disposed within the bore of the body and coupled to the electromagnetic activation system. The valve may include a mobile element and a static element. The mobile element may be coupled to the electromagnetic activation system and move from a first position where the mobile element obstructs fluid flow through the valve to a second position where the mobile element permits fluid flow through the valve. A cutter block may be movably coupled to the body and move radially-outward as the mobile element moves from the first position to the second position.

20 Claims, 12 Drawing Sheets

Related U.S. Application Data continuation of application No. 14/208,639, filed on Mar. 13, 2014, now Pat. No. 9,556,682, and a continuation-in-part of application No. 14/208,512, filed on Mar. 13, 2014, now Pat. No. 9,528,324.

(60) Provisional application No. 61/788,234, filed on Mar. 15, 2013.

(51) Int. Cl.

| | |
|---|---|
| ***E21B 34/06*** | (2006.01) |
| ***E21B 44/06*** | (2006.01) |
| ***E21B 7/28*** | (2006.01) |
| ***E21B 47/18*** | (2012.01) |
| ***E21B 7/128*** | (2006.01) |

(52) U.S. Cl.

CPC ..... *E21B 44/005* (2013.01); *E21B 44/06* (2013.01); *E21B 47/18* (2013.01)

(56) References Cited

U.S. PATENT DOCUMENTS

| | | | |
|---|---|---|---|
| 3,162,042 | A | 12/1964 | Hart |
| 3,163,038 | A | 12/1964 | Bryant |
| 3,238,776 | A | 3/1966 | Potter |
| 3,542,441 | A | 11/1970 | Nixon |
| 3,894,590 | A | 7/1975 | Takano et al. |
| 4,285,253 | A | 8/1981 | Edling |
| 4,358,253 | A | 11/1982 | Okano et al. |
| 4,560,014 | A | 12/1985 | Geczy |
| 4,566,317 | A | 1/1986 | Shakra |
| 4,825,421 | A | 4/1989 | Jeter |
| 4,871,301 | A | 10/1989 | Buse |
| 4,880,320 | A | 11/1989 | Haines et al. |
| 4,902,144 | A | 2/1990 | Thoren |
| 4,903,533 | A | 2/1990 | Kato et al. |
| 4,918,996 | A | 4/1990 | Kato et al. |
| 5,109,705 | A | 5/1992 | Masyagutov et al. |
| 5,146,789 | A | 9/1992 | Kato et al. |
| 5,228,786 | A | 7/1993 | Tanimoto et al. |
| 5,450,760 | A | 9/1995 | Lew et al. |
| 5,533,811 | A | 7/1996 | Polch et al. |
| 5,683,185 | A | 11/1997 | Buse |
| 5,685,797 | A | 11/1997 | Barnsby et al. |
| 6,002,643 | A | 12/1999 | Tchakarov et al. |
| 6,109,372 | A | 8/2000 | Dorel et al. |
| 6,732,617 | B2 | 5/2004 | Steinweg et al. |
| 6,732,817 | B2 | 5/2004 | Dewey et al. |
| 7,351,034 | B2 | 4/2008 | Cens et al. |
| 7,401,572 | B2 | 7/2008 | Donehue |
| 7,573,397 | B2 | 8/2009 | Petrovic et al. |
| 7,793,499 | B2 | 9/2010 | Gutknecht |
| 8,205,509 | B2 | 6/2012 | Oddie |
| 8,365,821 | B2 | 2/2013 | Hall et al. |
| 8,511,404 | B2 | 8/2013 | Rasheed |
| 9,447,676 | B2 | 9/2016 | Rasheed |
| 9,528,324 | B2 | 12/2016 | Fuller et al. |
| 9,556,682 | B2 | 1/2017 | Fuller et al. |
| 9,726,589 | B2 | 8/2017 | Zamora |
| 10,190,368 | B2 * | 1/2019 | Fuller ..... E21B 10/322 |
| 2003/0079913 | A1 | 5/2003 | Eppink et al. |
| 2004/0134687 | A1 | 7/2004 | Radford et al. |
| 2004/0222022 | A1 | 11/2004 | Nevlud et al. |
| 2005/0229718 | A1 | 10/2005 | Cens et al. |
| 2006/0120859 | A1 | 6/2006 | Cens et al. |
| 2007/0134106 | A1 | 6/2007 | McKeirnan |
| 2007/0204787 | A1 | 9/2007 | Donehue |
| 2008/0128169 | A1 | 6/2008 | Radford et al. |
| 2008/0134774 | A1 | 6/2008 | Oddie |
| 2008/0253888 | A1 | 10/2008 | Hsiao et al. |
| 2009/0114448 | A1 | 5/2009 | Laird et al. |
| 2010/0089583 | A1 | 4/2010 | Xu et al. |
| 2010/0116034 | A1 | 5/2010 | Abbott et al. |
| 2010/0154530 | A1 | 6/2010 | Oddie |
| 2010/0309746 | A1 | 12/2010 | Andersson |
| 2011/0127044 | A1 | 6/2011 | Radford et al. |
| 2011/0226531 | A1 | 9/2011 | Jones |
| 2012/0011928 | A1 | 1/2012 | Wootten |
| 2012/0080231 | A1 | 4/2012 | Radford et al. |
| 2012/0273187 | A1 | 11/2012 | Hall et al. |
| 2012/0308174 | A1 | 12/2012 | Head |
| 2012/0308365 | A1 | 12/2012 | Woollenweber et al. |
| 2013/0020092 | A1 | 1/2013 | Ramon et al. |
| 2013/0084035 | A1 | 4/2013 | Williams et al. |
| 2013/0127273 | A1 | 5/2013 | Lee |
| 2013/0206401 | A1 | 8/2013 | Bhoite et al. |
| 2013/0306373 | A1 | 11/2013 | Rasheed |
| 2014/0260560 | A1 | 9/2014 | Zamora |
| 2014/0262508 | A1 | 9/2014 | Fuller et al. |
| 2014/0262525 | A1 | 9/2014 | Fuller et al. |
| 2014/0332270 | A1 | 11/2014 | Odell et al. |
| 2015/0233299 | A1 | 8/2015 | Chekansky |
| 2015/0376963 | A1 | 12/2015 | Orban et al. |
| 2016/0084301 | A1 | 3/2016 | Baldassarre et al. |
| 2017/0051606 | A1 | 2/2017 | Fanini et al. |
| 2017/0101824 | A1 | 4/2017 | Fuller et al. |
| 2017/0227388 | A1 | 8/2017 | Vigneaux et al. |
| 2019/0145178 | A1 * | 5/2019 | Fuller ..... E21B 34/066 175/25 |
| 2019/0169945 | A1 | 6/2019 | Orban et al. |

FOREIGN PATENT DOCUMENTS

| | | | |
|---|---|---|---|
| WO | 9505581 | A1 | 2/1995 |
| WO | 2008150290 | A1 | 12/2008 |

OTHER PUBLICATIONS

International Preliminary Report on Patentability issued in International Patent Application No. PCT/US2014/027634, dated Sep. 15, 2015.

European Search Report issued in European Patent Application No. 14768506.9, dated Mar. 22, 2016, 4 pages.

Communication Pursuant to Article 94(3) issued in European Patent Application No. 14768506.9, dated Apr. 13, 2016, 5 pages.

Office Action issued in U.S. Appl. No. 14/208,512, dated Feb. 5, 2016, 12 pages.

International Search Report and Written Opinion issued in International Patent Application No. PCT/US2014/027527, dated Jul. 3, 2014, 10 pages.

International Preliminary Report on Patentability issued in International Patent Application No. PCT/US2014/027527, dated Sep. 15, 2015.

European Search and Exam Report issued in European Patent Application No. 14768849.3, dated Mar. 9, 2016, 6 pages.

European Search Report issued in European Patent Application No. 14768849.3, dated Feb. 12, 2016, 4 pages.

International Search Report issued in International Patent Application No. PCT/US2015/037320, dated Sep. 25, 2015, 3 pages.

International Preliminary Report on Patentability issued in International Patent Application No. PCT/US2015/037320, dated Jan. 3, 2017, 13 pages.

Office Action issued in U.S. Appl. No. 14/741,584, dated Mar. 16, 2018, 19 pages.

Office Action issued in U.S. Appl. No. 14/741,584, dated Aug. 21, 2017, 29 pages.

Office Action issued in U.S. Appl. No. 16/253,447 dated Feb. 3, 2020, 27 pages.

* cited by examiner

UNDERREAMER FOR INCREASING A WELLBORE DIAMETER

CROSS-REFERENCE TO RELATED APPLICATIONS

This application is a continuation of U.S. patent application Ser. No. 15/379,690, filed Dec. 15, 2016, which is a continuation of U.S. patent application Ser. No. 14/208,639, filed Mar. 13, 2014, which claims the benefit of U.S. Patent Application No. 61/788,234 filed on Mar. 15, 2013. U.S. patent application Ser. No. 15/379,690 is also a continuation-in-part of U.S. patent application Ser. No. 14/208,512, filed Mar. 13, 2014, which claims the benefit of U.S. Patent Application No. 61/788,234, filed on Mar. 15, 2013. The disclosure of each of the foregoing is expressly incorporated herein by this reference in its entirety.

FIELD

Embodiments described herein generally relate to downhole tools. More particularly, such embodiments relate to underreamers for increasing the diameter of a wellbore and methods for using same.

BACKGROUND INFORMATION

Wellbores are drilled by a drill bit coupled to the end portion of a drill pipe. The drill bit drills the wellbore to a "pilot hole" diameter. During or after the drilling of the wellbore to the pilot hole diameter, an underreamer may be used to enlarge the diameter of the wellbore from the original "pilot hole" diameter. The underreamer is run into the wellbore on the same drill pipe, behind the drill bill. The underreamer actuates between an inactive state and an active state. In the inactive state, cutter blocks on the underreamer are folded or retracted inwardly into the body of the underreamer such that the cutter blocks are positioned radially-inward from the surrounding casing or wellbore wall. Once the underreamer reaches the desired depth in the wellbore, the underreamer is actuated to an active state. In the active state, the cutter blocks move radially-outward and into contact with the wellbore wall. The cutter blocks are then used to increase the diameter of the wellbore.

Underreamers are generally spaced axially apart from the drill bit on the drill pipe. For example, the underreamer is typically positioned "above" the drill bit by about 30 m to about 60 m. As such, the underreamer is not able to increase the diameter of this lower portion (30 m-60 m) of the wellbore because the drill bit contacts the subterranean formation proximate the base of the wellbore, thereby preventing further downward movement of the underreamer. This portion of the wellbore that remains at the pilot hole diameter is called the "rat hole." What is needed, therefore, is an improved system and method for increasing the diameter of at least a portion of the rat hole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An underreamer for increasing a diameter of a wellbore is disclosed. The underreamer may include a body having an axial bore extending at least partially therethrough. An electromagnetic activation system (e.g., a motor) may be disposed at least partially within the bore of the body. A valve may be disposed within the bore of the body and coupled to the electromagnetic activation system. The valve may include a mobile element and a static element. The mobile element may be coupled to the electromagnetic activation system and move from a first position where the mobile element obstructs fluid flow through the valve to a second position where the mobile element permits fluid flow through the valve. A cutter block may be movably coupled to the body and move radially-outward as the mobile element moves from the first position to the second position.

A downhole tool is also disclosed. The downhole tool may include a body having an axial bore extending at least partially therethrough. A control unit may be disposed within the bore of the body. The control unit may include a sensor, a control electronic system, an electromagnetic activation system, and a valve. The sensor may receive a signal transmitted through the wellbore or a surrounding formation. The control electronic system may be coupled to the sensor and process the signal. The electromagnetic activation system may be coupled to the control electronic system move in response to the control electronic system processing the signal. The valve may be disposed within the bore of the body and coupled to the electromagnetic activation system. The valve may include a mobile element and a static element. The mobile element may be coupled to the electromagnetic activation system and move from a first position where the mobile element obstructs fluid flow through the valve to a second position where the mobile element permits fluid flow through the valve. A flow tube may be coupled to the valve and have fluid flow therethrough when the mobile element is in the second position.

A method for increasing a diameter of a wellbore is also disclosed. The method may include running a bottom hole assembly into a wellbore. The bottom hole assembly may include a body having an axial bore extending at least partially therethrough. A sensor may be disposed at least partially within the bore of the body. An electromagnetic activation system may be disposed within the bore of the body. A valve may be disposed within the bore of the body and coupled to the electromagnetic activation system. A cutter block may be movably coupled to the body. A signal may be transmitted through the wellbore or a surrounding formation to the sensor. A mobile element of the valve may be moved from a first position to a second position with electromagnetic activation system in response to the signal received by the sensor. The mobile element may obstruct fluid flow through the valve when in the first position and permit fluid flow through the valve when in the second position. The cutter block may move radially-outward in response to the mobile element moving from the first position to the second position.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
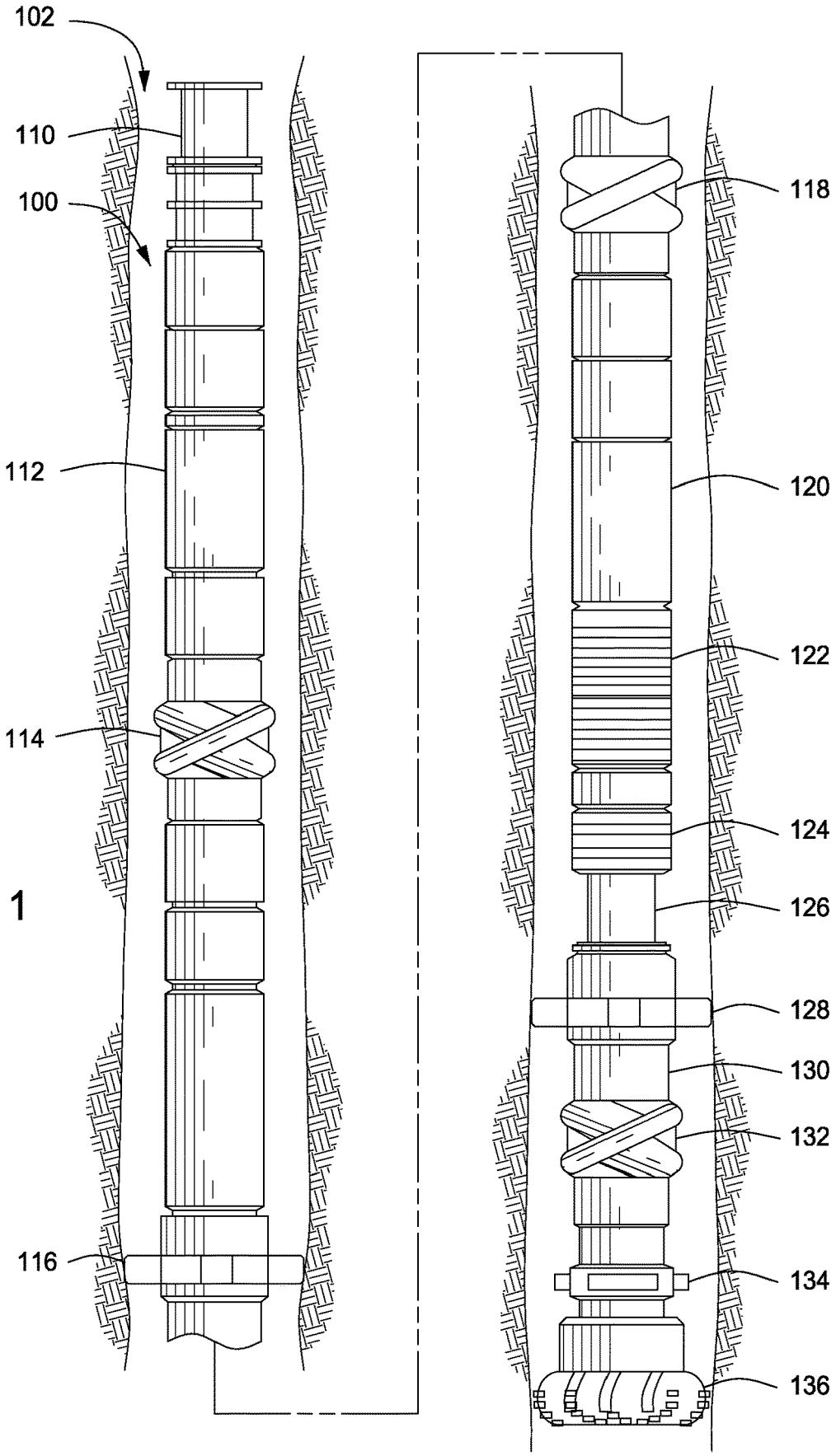
FIG. 1 depicts an illustrative bottom hole assembly disposed within a wellbore, according to one or more embodiments disclosed.

FIG. 1 depicts an illustrative bottom hole assembly 100 disposed within a wellbore 102, according to one or more embodiments. The bottom hole assembly 100 may be run into the wellbore 102 using a drill pipe 110. The bottom hole assembly 100 may include a drill collar 112, one or more stabilizers (three are shown 114, 118, 132), a first underreamer 116, a measuring-while-drilling ("MWD") tool 120, a logging-while-drilling ("LWD") tool 122, a communication device 124, a flexible joint 126, a second underreamer 128, a rotary steerable system ("RSS"), and a drill bit 136. In at least one embodiment, the rotary steerable system may include a control unit 130 and a bias unit 134.

The measuring-while-drilling tool 120 may include one or more sensors. The sensors may be used to measure directional parameters (e.g., azimuth and inclination) to assist the navigation of the bottom hole assembly 100. The sensors may also measure loads acting on the bottom hole assembly 100, such as weight on the drill bit 136 ("WOB"), torque on the drill bit 136 ("TOB"), and/or bending moments. The sensors may further measure axial, lateral, and/or torsional vibrations in the drill pipe 110 as well as the temperature and pressure of the fluids in the wellbore 102.

The logging-while-drilling tool 122 may include one or more sensors configured to measure properties of the formation and its contents such as formation porosity, density, lithology, dielectric constants, formation layer interfaces, and the pressure and permeability of the fluid in the formation. The measuring-while-drilling tool 120 and/or the logging-while-drilling tool 122 may be configured to send signals to the surface and receive signals from the surface, for example, by mud pulse telemetry. Although not shown, the bottom hole assembly 100 may include a bypass valve. The bypass valve may be positioned above the first underreamer 116 and be selectively activated for cleaning the wellbore 102.

The second underreamer 128 may be positioned along the bottom hole assembly 100 between the measuring-while-drilling tool 120 and the drill bit 136, between the logging-while-drilling tool 122 and the drill bit 136, between the communication device 124 and the drill bit 136, between the flexible joint 126 and the drill bit 136, between the control unit 130 and the drill bit 136 (not shown), or between the bias unit 134 and the drill bit 136 (not shown). A distance between the second underreamer 128 and the drill bit 136 may be less than about 50 m, less than about 40 m, less than about 30 m, less then about 20 m, less than about 15 m, less than about 10 m, less than about 7.5 m, less than about 5 m, or less than about 2.5 m.

Figure 2:
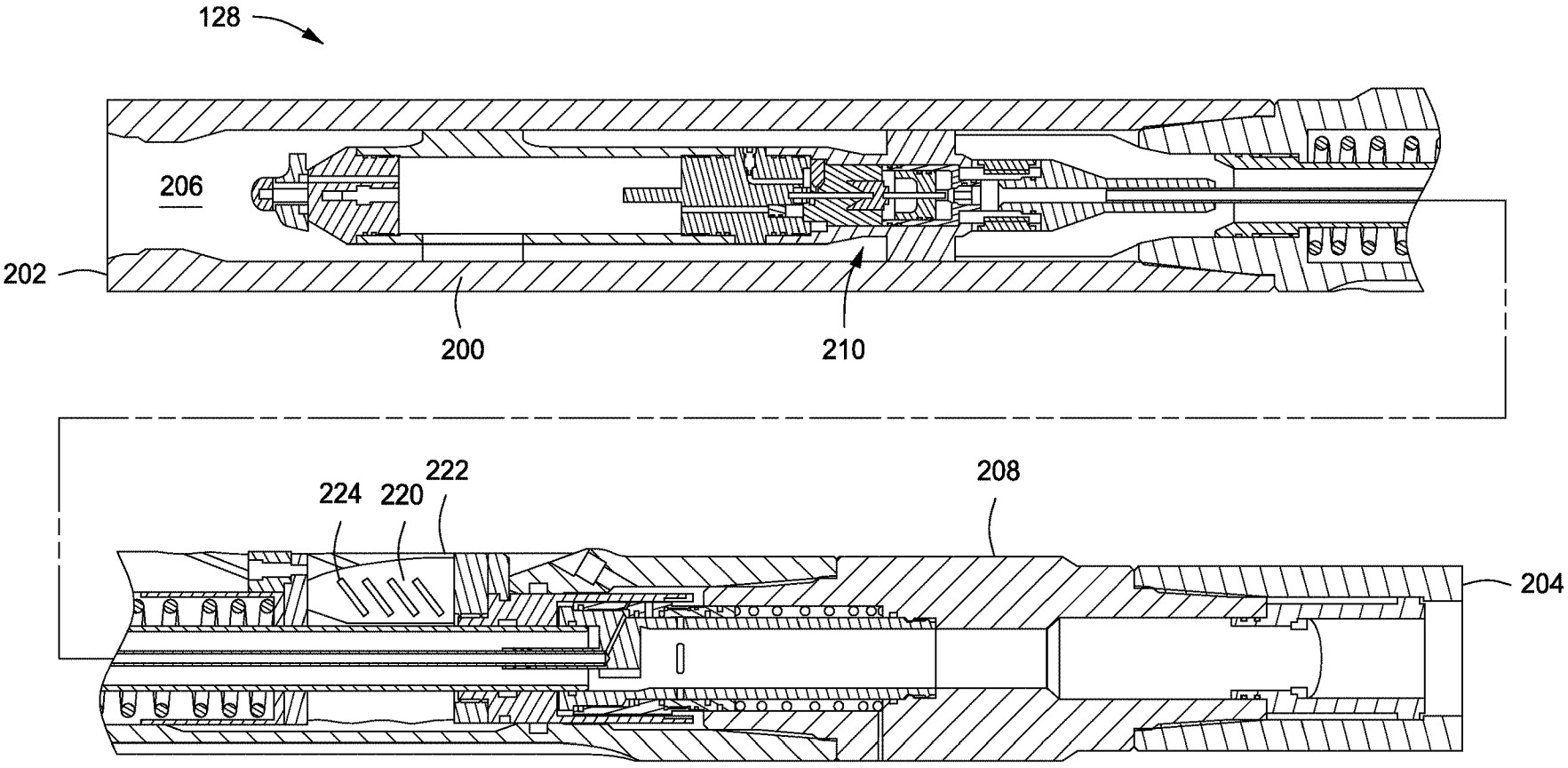
FIG. 2 is a partial cross-section view of an illustrative underreamer, according to one or more embodiments disclosed.

FIG. 2 depicts a partial cross-section view of the second underreamer 128, according to one or more embodiments. This particular embodiment includes a solenoid and a poppet valve, as shown in greater detail in FIG. 4. The second underreamer 128 includes a substantially cylindrical body 200 having an axial bore 206 extending at least partially (or completely) therethrough. The body 200 may be a single component, or the body 200 may be two or more components coupled together. The body 200 has a first or "upper" end portion 202 and a second or "lower" end portion 204.

One or more cutter blocks 220 are movably coupled to the body 200. Although a single cutter block 220 is shown, the number of cutter blocks 220 may range from a low of 1, 2, 3, or 4 to a high of 5, 6, 7, 8, or more. For example, the body 200 may have three cutter blocks 220 movably coupled thereto.

The second underreamer 128 is adapted to actuate from a first or inactive state (as shown in FIG. 2) to a second or active state. When the second underreamer 128 is in the inactive state, the outer (radial) surfaces 222 of the cutter blocks 220 are aligned with, or positioned radially-inward from, the outer (radial) surface 208 of the body 200. The external surface of the body 200 may have an overall shape of an undergage stabilizer, and the cutter blocks 220 may be contained in the blade of the undergage stabilizer. When in the inactive state, the outer (radial) surface 222 of the cutter blocks 220 may be retracted inside of the surface of the stabilizer blade. Such design/shape of the second underreamer 128, similar to the design/shape of an undergage stabilizer, may permit sufficient annular flow passage along the second underreamer 128. In another embodiment, when the second underreamer 128 is in the inactive state, the outer (radial) surfaces 222 of the cutter blocks 220 may be positioned radially-outward from the outer (radial) surface 208 of the body 200. In this embodiment, a ratio of the diameter of the outer (radial) surfaces 222 of the cutter blocks 220 to the outer (radial) surface 208 of the body 200 may be between about 1.01:1 and about 1.03:1, between about 1.02:1 and about 1.05:1, between about 1.05:1 and about 1.1:1, between about 1.1:1 and about 1.15:1, between about 1.01:1 and about 1.15:1, or more. When the cutter blocks 220 are positioned radially-outward from the body 200 in the inactive state, the cutter blocks 220 may stabilize the body 200 in the wellbore 102.

The cutter blocks 220 have a plurality of splines 224 (also known as a "Z-drive") formed on the outer (side) surfaces thereof. The splines 224 may be or include offset ridges or protrusions configured to engage corresponding grooves or channels in the body 200. The splines 224 on the cutter blocks 220 (and the corresponding grooves) are oriented at an angle with respect to a longitudinal axis through the body 200. The angle may range from a low of about 10°, about 15°, or about 20° to a high of about 25°, about 30°, about 35°, or more. For example, the angle may be between about 15° and about 25°, or about 17° and about 23°. Although four splines 224 are shown, it will be appreciated that the number of splines 224 may range from a low of 1, 2, 3, 4, or 5 to a high of about 10, about 15, about 20, about 25, about 30, or more.

When the second underreamer 128 transitions from the inactive state to the active state, the engagement of the splines 224 on the cutter blocks 220 and the grooves in the body 200 cause the cutter blocks 220 to simultaneously move axially toward the first end portion 202 of the body 200 and radially-outward. The resultant movement may be at an angle between about 15° and about 25°, or about 17° and about 23° with respect to the longitudinal axis through the body 200. This movement of the cutter blocks 220 transitions the second underreamer 128 into the active state.

Figure 8:
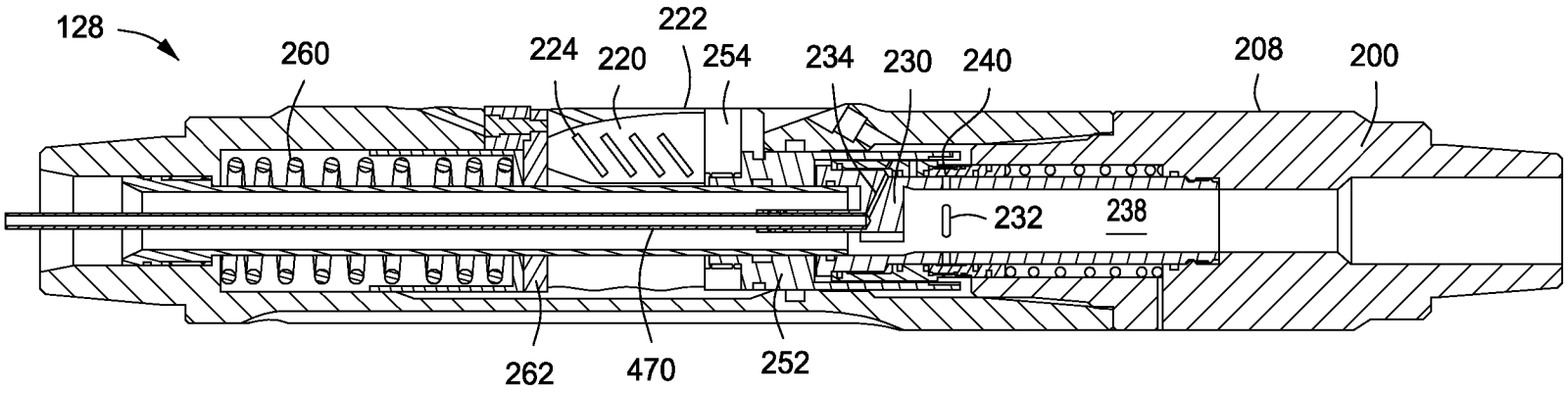
FIGS. 8 and 9 are partial cross-sectional views of the second underreamer in an inactive state, according to one or more embodiments disclosed.

When the second underreamer 128 is in the active state, the outer (radial) surfaces 222 of the cutter blocks 220 are positioned radially-outward from the outer (radial) surface 208 of the body 200 by a distance 226 (see FIG. 8). A ratio of the diameter of the outer (radial) surfaces 222 of the cutter blocks 220 to the outer (radial) surface 208 of the body 200 may be between about 1.1:1 and about 1.2:1, between about 1.15:1 and about 1.25:1, between about 1.2:1 and about 1.3:1, between about 1.25:1 and about 1.35:1, between about 1.3:1 and about 1.4:1 or more. In addition, a ratio of the distance 226 (see FIG. 10) to the diameter of the body 200 may range from a low of about 1:4, about 1:5, about 1:6, or about 1.7 to a high of about 1:8, about 1:9, about 1:10, about 1:12, or more.

The cutter blocks 220 each have a plurality of cutting contacts or elements disposed on the outer (radial) surface 222 thereof. The cutting contacts of the cutter blocks 220 may include polycrystalline diamond compact ("PDC") or the like. The cutting contacts on the cutter blocks 220 are adapted to cut, grind, shear, and/or crush the wall of the wellbore 102 to increase the diameter thereof when the second underreamer 128 is in the active state. The cutter blocks 220 may also include a plurality of stabilizer pads (not shown) disposed on the outer (radial) surface 222 thereof. When the cutter blocks 220 include cutting contacts and stabilizer pads, the cutter blocks 220 may function as a cleanout stabilizer. When the cutter blocks 220 include stabilizer pads but no cutting contacts, the cutter blocks 220 may function as an expandable stabilizer.

A first cutter block 220 of the second underreamer 128 may have a different height (as measured radially outward from the body 200) than a second cutter block (not shown). For example, the first cutter block 220 may have a greater height than the second cutter block. In this embodiment, the first cutter block 220 may act as a stabilizer when the second underreamer 128 is in the inactive state, and the first cutter block 220 may push the body 200 off the longitudinal axis of the wellbore 102 when the second underreamer 128 is in the active state to allow bi-centric cutting to occur.

A control unit 210, e.g., a remote control unit, is disposed within the bore 206 of the body 200. The control unit 210 is configured to actuate the cutter blocks 220 from the inactive state to the active state and vice versa, as described in greater detail below. Although the control unit 210 is shown positioned above the component (e.g., cutter blocks 220) that the control unit 210 actuates, the control unit 210 may also be positioned below the component that the control unit 210 actuates. The control unit 210 may be disposed within and configured to actuate a mechanical device such as the first underreamer 116, a pipe cutter, a section mill, a bypass valve, a whipstock anchor, or any other component coupled to or disposed within any downhole tool or bottom hole assembly.

The mechanical device may have at least two positions. For example, a pipe cutter, a section mill, or a variable gauge stabilizer may be retracted or extended, a bypass valve may be open or closed, a whipstock anchor which may be retracted or expanded (for anchoring), a drill string agitator may be locked or in agitation mode, or a jar may be locked or set to ready mode to be triggered. The control unit 210 may select the mode of the mechanical devices via the setting of a valve (introduced below).

Figure 3:
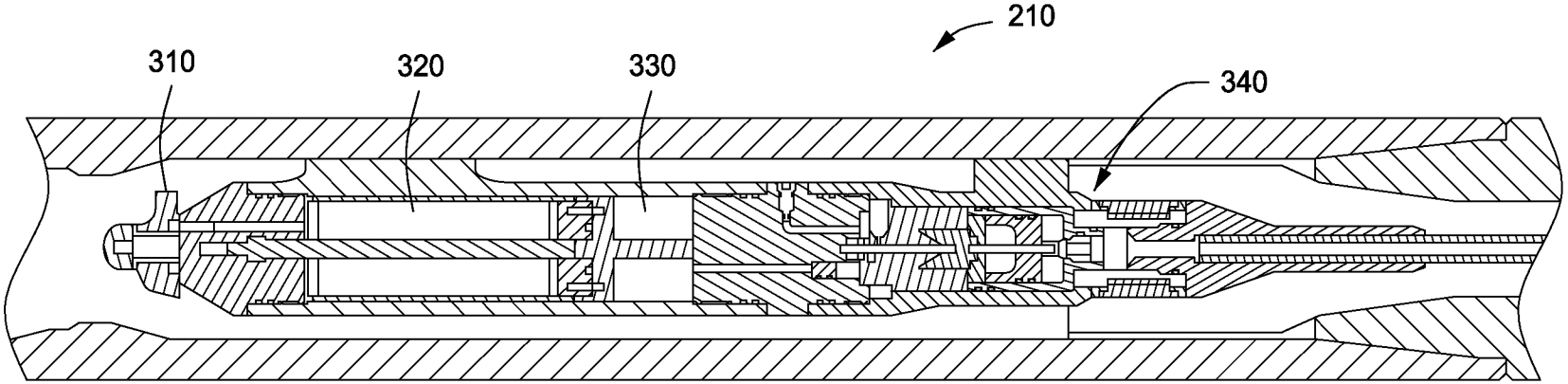
FIG. 3 is a partial cross-section view of an illustrative control unit in a second underreamer, according to one or more embodiments disclosed.

FIG. 3 depicts a partial cross-sectional view of the control unit 210, according to one or more embodiments. The control unit 210 may include one or more sensors (one is shown 310), a source of electricity (e.g., one or more batteries 320) to provide electrical power, an electronics unit 330, and an actuator unit 340. In another embodiment, the source of electricity may be or include a turbo-generator installed in the vicinity of the control unit 210. The mud flow inside the drill string may set in rotation the turbo-generator which delivers electricity to the control unit 210. The one or more sensors 310 are adapted to receive one or more signals, e.g., hydraulic signals, transmitted through the wellbore 102, e.g., via the drill pipe 110, from the surface that direct the control unit 210 to actuate the second underreamer 128 from the inactive state to the active state, or vice versa. In at least one embodiment, the bottom hole assembly 100 (FIG. 1) may include a plurality of control units or control systems, and each control unit may send and/or receive different signals. Each control unit may be used to actuate a different component (e.g., underreamer) of the bottom hole assembly 100.

The sensor 310 may be or include a flow sensor, a pressure sensor, a delta-pressure sensor (across the collar wall), a vibration sensor, or combinations of such sensors, and the signals may be in the form of flow pulses/variations, pressure pulses/variations, or vibration pulses/variations.

The sensing may also be based on an electromagnetic signal (i.e., current) sent from the surface to the bottom hole assembly 100. In such applications, the current path may be via the formation and the drill string. The sensing method (and associated sensor) may be used to determine the current in the collar. In at least one embodiment, the sensor may be a toroid around the collar. In another embodiment, the sensing method may be an "electrical gap" in the drill string obtained by insulating a tubular joint, and measurement of the current from one side to the other side of the "electrical gap" may be accomplished via a measurement amplifier inside the control unit 210.

The sensing may also be based on an acoustic signal sent through the mud in the wellbore. A hydrophone may be used as the sensor for detecting the signal. In another embodiment, the sensing may be based on an acoustic signal sent on or through the steel of the drill string, and the sensor may be or include an accelerometer or geophone coupled to the collar steel of the tool. In yet another embodiment, the sensing may be based on an acoustic signal sent on or through the surrounding formation, and the sensor may be a seismic-type sensor in the tool for the detection of the signal.

The electronics unit 330 may interpret the signals received by the sensor 310. In response to the signals, the electronics unit 330 may control the actuator unit 340.

Figure 4:
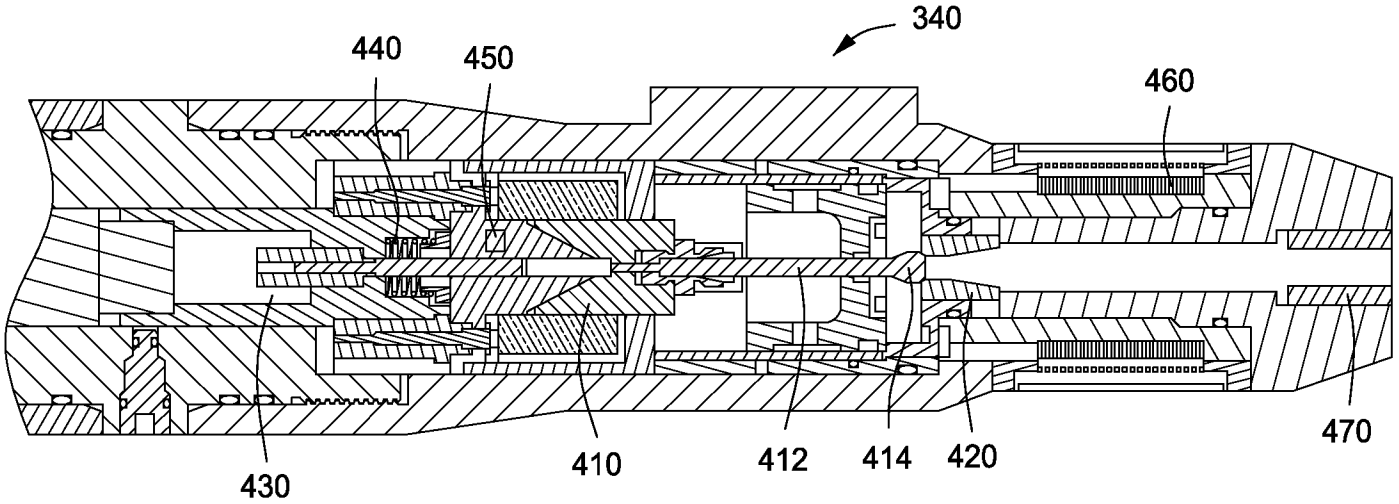
FIG. 4 is a partial cross-section view of an illustrative actuator unit when the second underreamer is in an inactive state.
Figure 5:
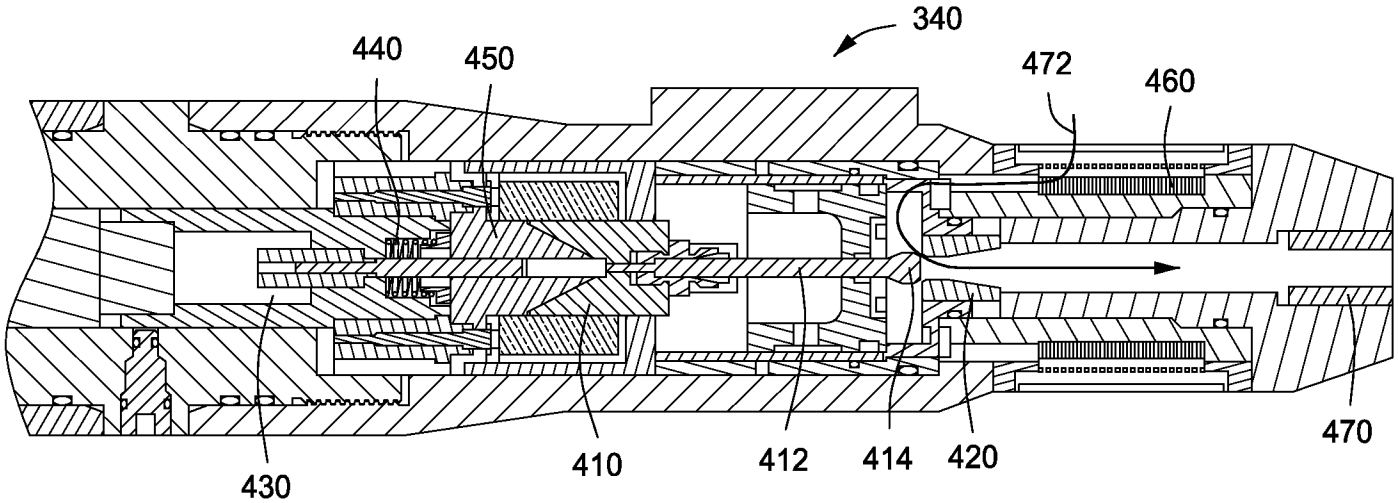
FIG. 5 is a partial cross-section view of the actuator unit when the second underreamer is in an active state, according to one or more embodiments disclosed.

FIG. 4 depicts a partial cross-sectional view of the actuator unit 340 when the second underreamer 128 is in the inactive state, and FIG. 5 depicts a partial cross-sectional view of the actuator unit 340 when the second underreamer 128 is in the active state, according to one or more embodiments. The actuator unit 340 may include a solenoid 410 having a shaft 412 coupled thereto. A mobile element, such as plunger or valve 414 (e.g., a poppet valve), on an end portion of the shaft 412 is configured to sealingly engage a static element (e.g., a valve seat) 420 to prevent fluid flow therethrough when the second underreamer 128 is in the inactive state (see FIG. 4). The plunger 414 and/or the valve seat 420 may be made of ceramic transition-toughened zirconia, tungsten carbide, polycrystalline diamond, stellite, or the like. The stroke of the plunger 414 may be from about 0.5 mm to about 5 mm.

When the control unit 210 determines that the second underreamer 128 is to actuate into the active state, the control unit 210 directs, e.g., by supplying electrical current to, the solenoid 410 and the shaft 412 to move axially with respect to the valve seat 420 to allow fluid flow through the valve seat 420. As shown, the solenoid 410 and the shaft 412 move toward the first end portion 202 of the body 200 (to the left as shown in FIG. 5) a small distance. The distance may be from about 0.5 mm to about 5 mm or about 1 mm to about 2.5 mm. In other embodiments, the distance may be from about 5 mm to about 10 mm, about 10 mm to about 20 mm, about 20 mm to about 40 mm, or more.

A position sensor 430 may be used to determine the position of the solenoid 410 and the shaft 412 and, thus, the state of the second underreamer 128. The position sensor 430 may communicate the position back to the electronics unit 330 in the control unit 210. Such position information permits the control unit 210 to lower the current applied to the solenoid 410 after opening the valve 414. The action of valve opening includes a larger pull force (and current applied to solenoid 410) than maintaining the valve 414 in the open position. This selective reduction in current applied to the solenoid 410 lowers the energy consumption from the one or more batteries 320. The heat output from the electronics unit 330 and solenoid 410 are also reduced. Based on feedback from the position sensor 430, the electronics unit 330 may reapply current to the solenoid 410 to open the valve 414 when the actuator unit 340 closes at least partially due to external perturbations, such shocks, flows or pressure conditions, or other causes, such as spring bias. The status of the position sensor 430 may be conveyed from the control unit 210 to the measuring-while-drilling tool 120 (see FIG. 1) for transmission uphole, e.g., via mud pulse telemetry, such that underreamer setting may be monitored.

The position of the plunger or valve 414 may correspond to the last successfully received signal/command received from uphole. Under high-shock drilling conditions, the plunger or valve 414 may be inadvertently set in an undesirable position, (e.g., when there is little to no fluid flow through axial bore 106). The electronics unit 330 monitors and/or verifies the position of plunger or valve 414 via the position sensor 430 and compares the sensed position to the desired/expected position. If the electronics unit 330 determines that the plunger or valve 414 is in an undesirable position, then the electronics unit 330 initiates a new actuation of the actuator 340.

The actuator 340 may be arranged and designed such that actuation to the open position occurs when there is little to no fluid flow through the axial bore 206. When there is little to no fluid flow through the axial bore 206, there may also be little to no pressure differential between the axial bore 206 and the well annulus. Thus, valve 414 experiences minimal, if any, self-closing effects due to pressure differential. The actuation of the actuator 340 under minimal self-closing effects may allow smaller currents and smaller components to be used.

When the solenoid 410 and the shaft 412 move toward the first end portion 202 of the body 200, the solenoid 410 compresses a spring 440. A locking unit 450 may secure or "lock" the solenoid 410 and the shaft 412 in place when the second underreamer 128 is in the active state, thereby maintaining the spring 440 in the compressed state. Thus, the actuator 340 may be maintained in the open position without application of a current. A short duration current pulse may control the locking unit 450 during in the opening of the actuator 340. The locking unit 450 may be a secondary solenoid which moves a lock pin, and the lock pin may engage in the plunger or valve 414 or the solenoid 410. In another embodiment, the solenoid 410 may stay energized until a deactivate command is received. Nevertheless, even if a constant or near constant current is used to energize the solenoid to maintain the actuator 340 in an open position, the current used to maintain the open position may be less than the current used to actuate the plunger or valve 414 to the open position, e.g., from closed or near closed position.

Once the second underreamer 128 is in an active state, fluid may flow radially-inward through a filter 460. The filter 460 is configured to prevent particles (e.g., sand drilling fluid additives such as LCM, and other contaminants) from flowing therethrough to the control unit 210. More particularly, the filter 460 is configured to prevent particles from passing therethrough that would prevent the plunger or valve 414 from sealing against the valve seat 420 or would plug the channel or port 234 (see FIG. 8). The filter 460 may be constructed of a wrapped trapezoid wire, as used in sand control operations. The external surface of the filter 460 may be kept clean by ensuring that mud velocity around the filter 460 is sufficient (e.g., above 20 feet/second). The flow restrictor may be chosen in accordance with the fluid flow rate to keep the flow velocity sufficient for filter self-cleaning. Once through the filter 460, the fluid may then flow toward the first end portion 202 of the body 200, through the valve seat 420 (now unobstructed by the plunger 414), and through a flow tube 470 toward the second end portion 204 of the body 200. The flow path of the fluid is indicated by the arrows 472 in FIG. 5.

When the control unit 210 determines that the second underreamer 128 is to actuate back into the inactive state, the control unit 210 de-energizes the solenoid 410 (or the locking unit 450 releases the solenoid 410), and the compressed spring 440 moves the solenoid 410 and the shaft 412, thereby moving the plunger 414 back into sealing engagement with the valve seat 420 to once again prevent fluid flow through the valve seat 420 and the flow tube 470.

Figure 6:
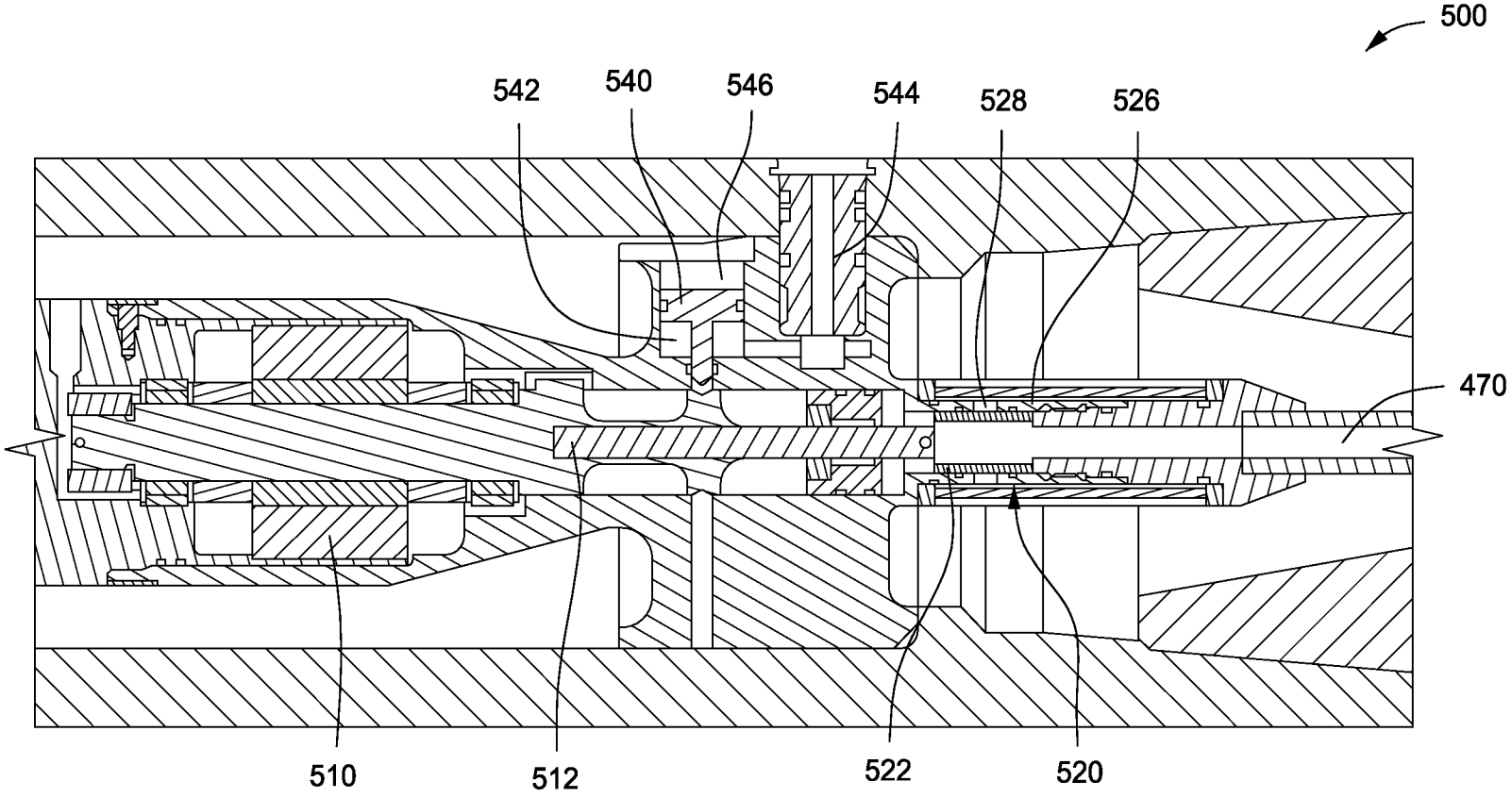
FIG. 6 is a partial cross-sectional view of another illustrative actuator unit when the second underreamer is in the inactive state.
Figure 7:
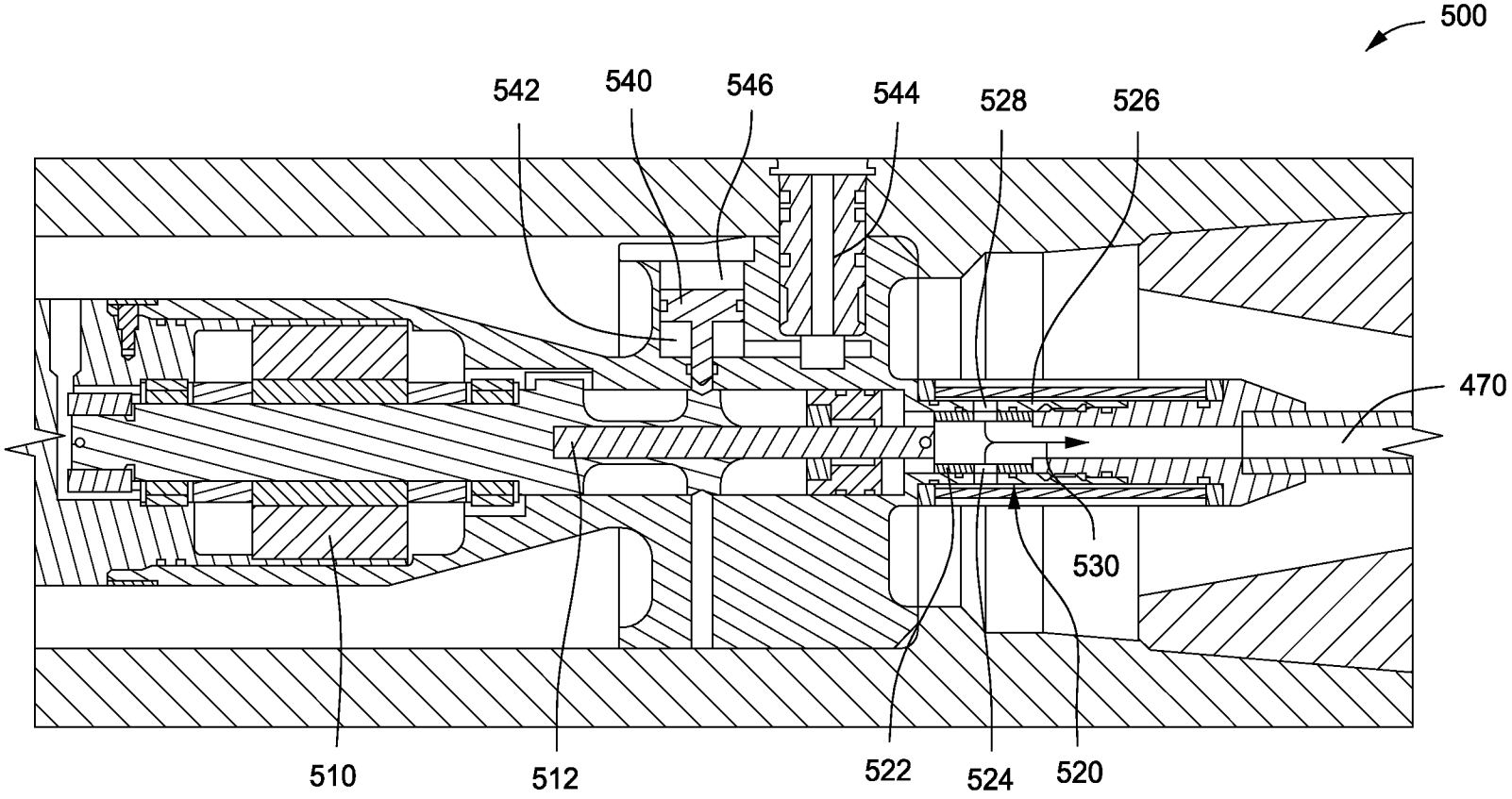
FIG. 7 depicts a partial cross-sectional view of the actuator unit when the second underreamer is in the active state, according to one or more embodiments disclosed.

FIG. 6 depicts a partial cross-sectional view of another illustrative actuator unit 500 (involving a rotary motor and rotary valve) when the second underreamer 128 is in the inactive state, and FIG. 7 depicts a partial cross-sectional view of the actuator unit 500 when the second underreamer 128 is in the active state, according to one or more embodiments. The actuator unit 500 may include an electromagnetic activation system (e.g., a motor or electric motor) 510. The electronics unit 330 may cause the motor 510 to rotate about a longitudinal axis extending therethrough in response to one or more signals, such as pressure signals, received by the sensor 310 (see FIG. 3). The motor 510 may be configured to rotate a predetermined amount in response to each signal. The predetermined amount may range from about 5°, about 10°, about 20°, about 30°, or about 45° to about 60°, about 75°, about 90°, about 180°, or more. For example, in response to a signal received by the sensor 310, the motor 510 may rotate about 5° to about 30°, about 30° to about 60°, about 60° to about 90°, about 90° to about 180°, or about 5° to about 180°.

The motor 510 may have a shaft 512 coupled thereto and configured to rotate therewith. The shaft 512 may be coupled to a valve 520. The valve 520 may be made of diamond, ceramic, tungsten carbide, alloy steel, stellite, thermoplastic, combinations thereof, and the like. The valve 520 may include a mobile element (e.g., rotor) 522 and a static element (e.g., a stator) 526. The rotor 522 may be coupled to the shaft 512 and configured to rotate therewith. The stator 526 may be stationary with respect to the rotor 522. The stator 526 may be positioned radially-outward from the rotor 522, as shown. In another embodiment, the stator 526 may be positioned radially-inward from the rotor 522.

The rotor 522 may have one or more ports or openings 524 formed radially therethrough. The openings 524 may be axially and/or circumferentially offset from one another. Although not shown, in another embodiment, the one or more openings 524 may be formed axially through the rotor 522 and be radially and/or circumferentially offset from one another. The number of openings 524 may range from a low of 1, 2, 3, 4, or 5 to a high of 10, 20, 30, 40, 50, or more.

The stator 526 may also have one or more ports or openings 528 formed radially therethrough. The openings 528 may be axially and/or circumferentially offset from one another. Although not shown, in another embodiment, the one or more openings 528 may be formed axially through the stator 526 and be radially and/or circumferentially offset from one another. The number of openings 528 may range from a low of 1, 2, 3, 4, or 5 to a high of 10, 20, 30, 40, 50, or more. The openings 524, 528 may be arranged and designed to align with one another when the second underreamer 128 is in the active state, and to be misaligned when the second underreamer 128 is in the inactive state, as described below.

The rotation of the rotor 522 may cause the second underreamer 128 to actuate between the inactive state and the active state. When second underreamer 128 is in the inactive state, the openings 524 in the rotor 522 are not aligned with the openings 528 in the stator 526. As such, the stator 526 may obstruct the openings 524 in the rotor 522, thereby preventing the fluid from flowing therethrough and into the flow tube 470.

When the sensor 310 receives a signal to actuate the second underreamer 128 to the active state, the motor 510 may rotate the rotor 522 until the openings 524 in the rotor 522 are aligned with corresponding openings 528 in the stator 526. When the openings 524, 528 are aligned, a path of fluid communication is provided therethrough. As such, the fluid may flow through the openings 524, 528 and into the flow tube 470 toward the second end portion 204 of the body 200. The flow path of the fluid is indicated by the arrows 530 in FIG. 7.

The motor 510 and the valve 520 may be arranged and designed such that rotation of the motor 510 and the rotor 522 of the valve 520 occurs when there is little to no fluid flow through the axial bore 206. For example, the rotation of the motor 510 and the rotor 522 may occur when the fluid flow through the bore 206 of the body 200 is less than about 1000 L/min, less than about 500 L/min, less than about 250 L/min, less than about 100 L/min, less than about 50 L/min, less than about 25 L/min, less than about 10 L/min, or about 0 L/min. When there is little to no fluid flow through the axial bore 206, there may also be little to no pressure differential between the axial bore 206 and the well annulus. Thus, valve 520 experiences minimal, if any, self-closing effects due to pressure differential.

When there is fluid flow through the axial bore 206, or when fluid flow through the axial bore 206 increases above the predetermined level, a pressure differential in a locking mechanism 540 causes the locking mechanism 540 to engage the motor 510 and/or the shaft 512 to prevent the motor 510 and the shaft 512 from rotating the rotor 522 in the valve 520. More particularly, a first side 542 of the locking mechanism 540 is in fluid communication with the well annulus through an opening 544, and a second side 546 of the locking mechanism 540 is in fluid communication with the fluid in the axial bore 206. As shown, the first side 542 is positioned radially inward from the second side 546. When there is fluid flow through the axial bore 206, or when fluid flow through the axial bore 206 increases, the pressure of the fluid proximate the second side 546 of the locking mechanism 540 increases while the pressure of the fluid proximate the first side 542 of the locking mechanism 540 remains substantially constant. This causes the locking mechanism 540 to move radially-inward until the locking mechanism 540 engages the motor 510 and/or the shaft 512 to prevent the motor 510 and the shaft 512 from rotating the rotor 522 in the valve 520. This pressure-actuated locking mechanism 540 may increase the life of the batteries 320 because the batteries 320 supply power to the motor 510 when the valve 520 is to be actuated; however, no power is used between actuations.

The lock of the motor 510 and the valve 520 may also be achieved by the use of the solenoid 410, which may activate a lock pin. The solenoid 410 and the lock pin may be mounted perpendicular to the axis of rotation of the motor 510 and the valve 520. The lock pin may engage in a radial hole of the rotary component to prohibit any rotation. Current may be applied to the solenoid 410 to disengage the lock pin before driving the motor 510 and the valve 520 in rotation. After the rotation of the motor 510 and the valve 520, the current may be removed from the solenoid 410, and a spring may push the solenoid 410 and the lock pin into the lock mode (by re-engaging the lock pin into a hole in the rotary components).

The lock of the motor 510 and the rotor 522 in the valve 520 (e.g., valve mobile element) may also be obtained by a radial pin entering a small slot of the rotary element (e.g., the motor 510 or valve 520). The pin may be disengaged by the action of a secondary solenoid associated with a spring: the pin, the slot (not shown). The valve 520 may be made from diamond (Polycrystalline diamond), tungsten carbide, ceramic, stellite, alloy steel, or thermo-plastic.

Figure 9:
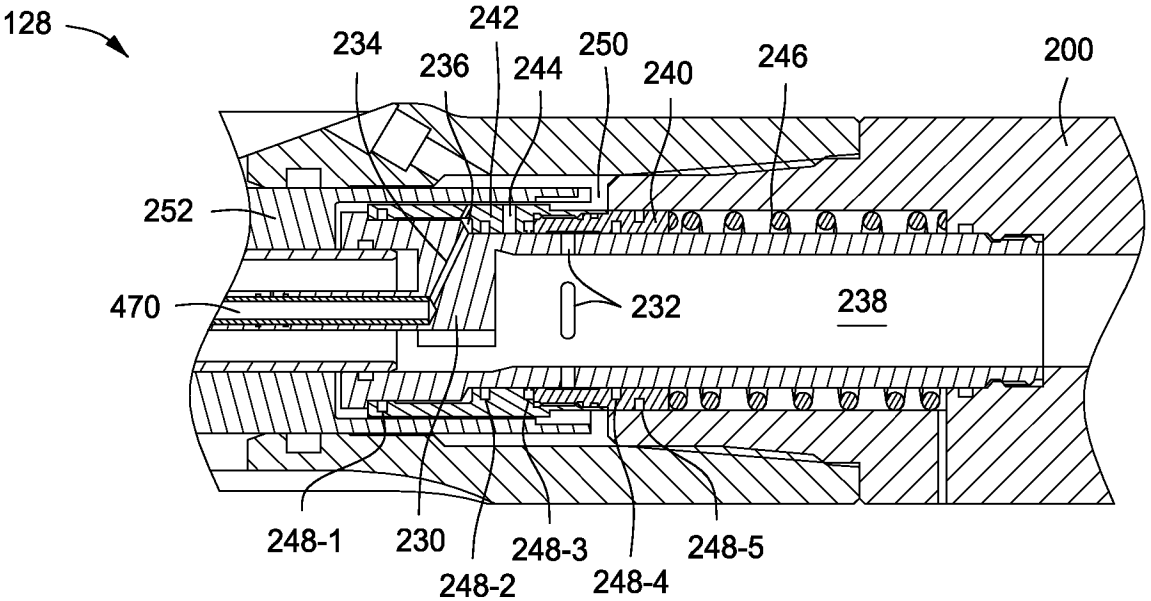

FIGS. 8 and 9 depict partial cross-section views of the second underreamer 128 in the inactive state, according to one or more embodiments. The flow tube 470 may be coupled to and in fluid communication with a mandrel 230 disposed within the bore 206 of the body 200. The mandrel 230 may have one or more ports or openings 232 formed radially therethrough. For example, mandrel 230 may include a plurality of openings 232 that are circumferentially-offset from one another. When the second underreamer 128 is in the inactive state, an annular sleeve 240 disposed radially-outward from the mandrel 230 is axially aligned with the openings 232 and prevents fluid flow therethrough. This causes the cutter blocks 220 to be positioned in the inactive state, as shown in FIG. 8.

Figure 10:
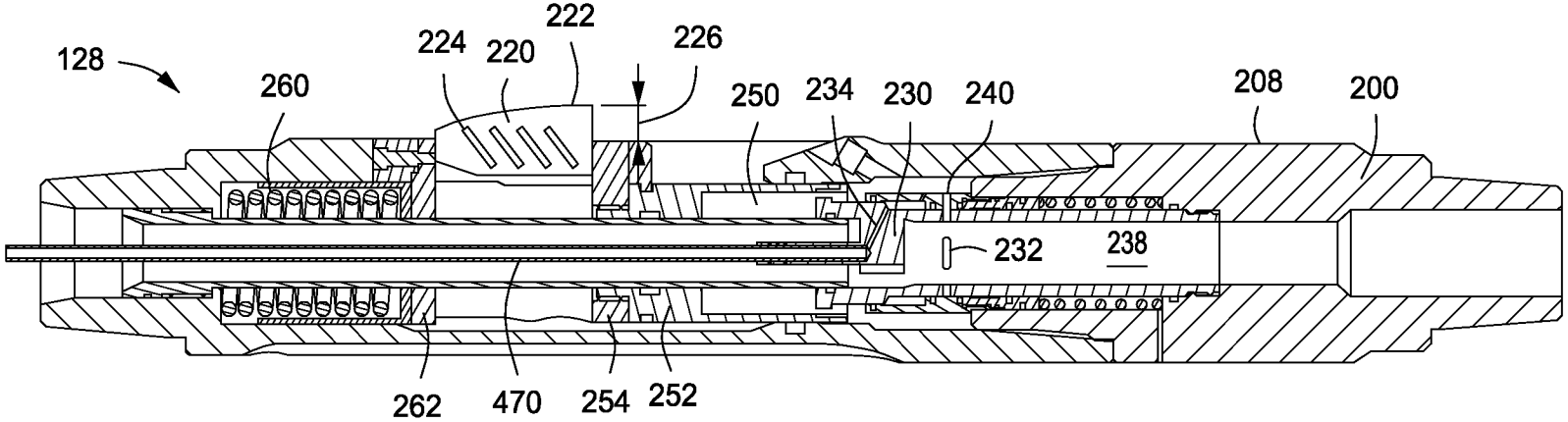
FIGS. 10 and 11 are partial cross-sectional views of the second underreamer in an active state, according to one or more embodiments disclosed.
Figure 11:
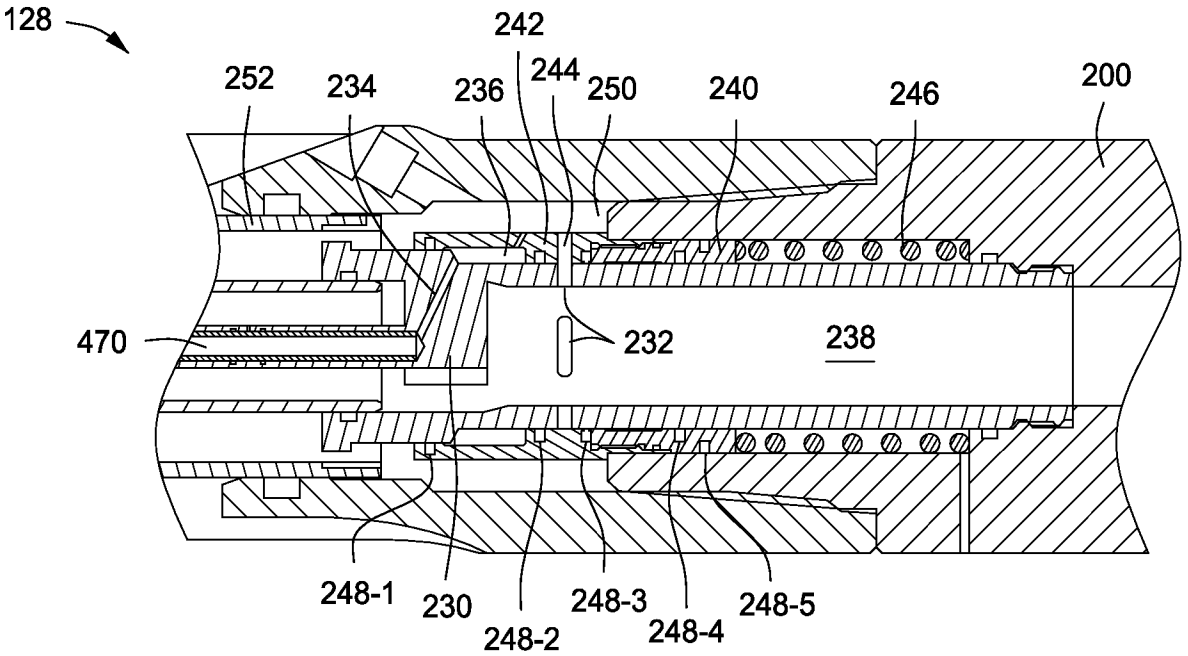

FIGS. 10 and 11 depict partial cross-sectional views of the second underreamer 128 in the active state, according to one or more embodiments. When the second underreamer 128 is actuated into the active state, fluid flows through the valve seat 420 (see FIGS. 5 and 7) and the flow tube 470 toward the second end portion 204 of the body 200 (to the right as shown in FIGS. 10 and 11). The fluid then flows radially-outward through a channel 234 formed in the mandrel 230 into a first chamber 236. As the fluid flows into the first chamber 236, the pressure in the first chamber 236 increases. This increase in pressure causes a first piston 242 to move axially toward the second end portion 204 of the body 200 (to the right as shown in FIGS. 10 and 11). The movement of the first piston 242 causes the sleeve 240 to also move axially toward the second end portion 204 of the body 200, thereby compressing a spring 246. In at least one embodiment, the first piston 242 and the sleeve 240 may be a single component.

A plurality of seals (five are shown: 248-1, 248-2, 248-3, 248-4, 248-5) may prevent the fluid from leaking between adjacent components. The seals 248-1, 248-2, 248-3, 248-4, 248-5 may be dynamic and adapted to move with the first piston 242 and/or the sleeve 240. The seals 248-1, 248-2, 248-3, 248-4, 248-5 may be made from rubber, an elastomer, lapped carbide, Teflon®, metal rings, or the like.

When the first piston 242 and the sleeve 240 move toward the second end portion 204 of the body 200, the sleeve 240 uncovers the one or more openings 232 in the mandrel 230, and one or more openings 244 formed radially through the first piston 242 become aligned with the one or more openings 232 in the mandrel 230. When the openings 232, 244 are aligned, fluid may flow from a bore 238 in the mandrel 230 through the openings 232, 244, and into a second chamber 250. As the fluid flows into the second chamber 250, the pressure in the second chamber 250 increases. The pressure in the first chamber 236 and the second chamber 250 may equalize, and the flow in the flow tube 470 may become stagnant. The increase in pressure causes a second piston 252 to move axially toward the first end portion 202 of the body 200 (to the left as shown in FIGS. 10 and 11). The movement of the second piston 252 causes a drive ring 254 to also move axially toward the first end portion 202 of the body 200. The drive ring 254 exerts a force on the cutter blocks 220 in a direction toward the first end portion 202 of the body 200.

When the drive ring 254 exerts the axial force on the cutter blocks 220 in a direction toward the first end portion 202 of the body 200, the engagement of the splines 224 on the cutter blocks 220 and the grooves in the body 200 cause the cutter blocks 220 to simultaneously move axially toward the first end portion 202 of the body 200 and radially outward. The resultant movement may be at an angle between about 15° and about 25°, or about 17° and about 23° with respect to the longitudinal axis through the body 200. This movement of the cutter blocks 220 transitions the second underreamer 128 into the active state. When the second underreamer 128 is in the active state, the cutter blocks 220 are positioned as shown in FIG. 10 such that the outer (radial) surfaces 222 of the cutter blocks 220 are radially-outward from the outer (radial) surface 208 of the body 200.

Figure 12:
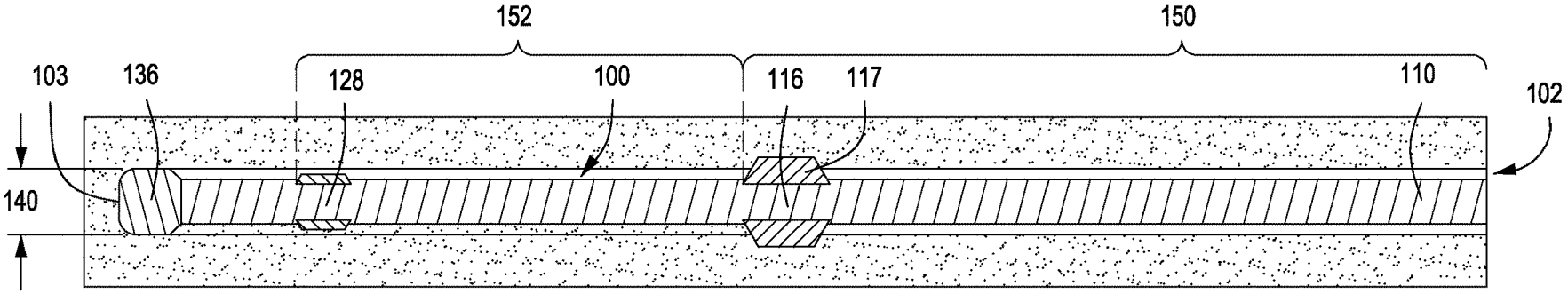
FIGS. 12, 13 and 14 depict a first illustrative sequence of the first and second underreamers for increasing the diameter of the wellbore, according to one or more embodiments disclosed.
Figure 13:
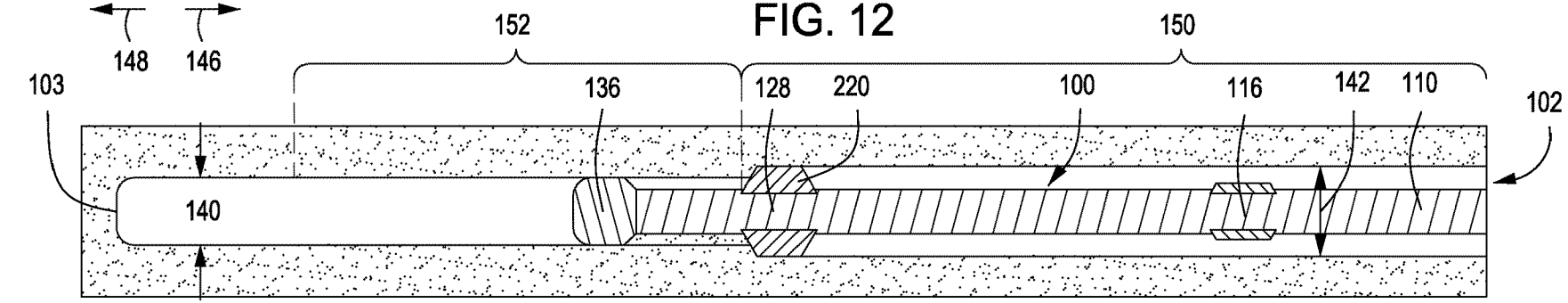
Figure 14:
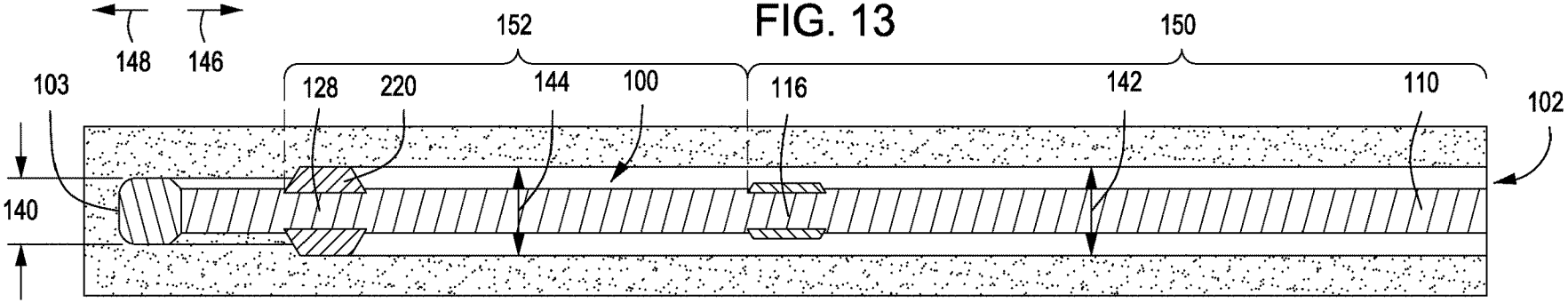

FIGS. 12, 13 and 14 depict a first illustrative sequence of the first and second underreamers 116, 128 increasing the diameter of the wellbore 102, according to one or more embodiments. In operation, the drill pipe 110 runs the bottom hole assembly 100 with the first and second underreamers 116, 118 coupled thereto into the wellbore 102. The first and second underreamers 116, 118 may be in the inactive state while the drill bit 136 drills the wellbore 102 to a first "pilot hole" diameter 140, as shown in FIG. 12. The first diameter 140 may range from a low of about 5 cm, about 10 cm, about 15 cm, or about 20 cm to a high of about 30 cm, about 40 cm, about 50 cm, about 60 cm, or more. For example, the first diameter 140 may be from about 5 cm to about 15 cm, from about 10 cm to about 20 cm, from about 15 cm to about 25 cm, from about 20 cm to about 30 cm, from about 25 cm to about 35 cm, from about 30 cm to about 40 cm, from about 35 cm to about 45 cm, from about 40 cm to about 50 cm, from about 45 cm to about 55 cm, from about 50 cm to about 60 cm, or more. Once the drill bit 136 reaches the desired depth, as shown in FIG. 12, the portion of the wellbore 102 below the first underreamer 116 has the first diameter 140.

After the drill bit 136 drills the wellbore 102 to the desired depth, the first underreamer 116 may be actuated into the active state, as shown in FIG. 12. When the first underreamer 116 is in the active state, the drill pipe 110 may pull the bottom hole assembly 100 back toward the surface (i.e., upward, as shown by arrow 146). As the first underreamer 116 moves upward, the cutter blocks 117 (now expanded radially-outward) cut and/or grind the wall of the wellbore 102 to increase the diameter of a first portion 150 of the wellbore 102 from the first diameter 140 to a second diameter 142. The first portion 150 of the wellbore 102 extends upward from the position of the first underreamer 116 when the drill bit 136 is positioned proximate the base 103 of the wellbore 102. The second diameter 142 may be from about 10 cm to about 20 cm, from about 15 cm to about 25 cm, from about 20 cm to about 30 cm, from about 25 cm to about 35 cm, from about 30 cm to about 40 cm, from about 35 cm to about 45 cm, from about 40 cm to about 50 cm, from about 45 cm to about 55 cm, from about 50 cm to about 60 cm, about 55 cm to about 65 cm, about 60 cm to about 70 cm, or more.

After the first underreamer 116 has increased the diameter of the first portion 150 of the wellbore 102, the second underreamer 128 is actuated into the active state, as shown in FIG. 13. The second underreamer 128 may be positioned within the first portion 150 of the wellbore 102 when actuated into the active state; however, in another embodiment, the second underreamer 128 may also be positioned within a second portion 152 of the wellbore 102 when actuated into the active state. The second portion 152 of the wellbore 102 extends from the position of the first underreamer 116 to the position of the second underreamer 128 when the drill bit 136 is positioned proximate the base 103 of the wellbore 102. The second portion 152 of the wellbore 102 is also known as the "rat hole."

To actuate the second underreamer 128 into the active state, one or more signals are sent down the wellbore 102 from the surface and received by the sensor 310 in the control unit 210. The fluid flow rate through axial bore 106 may be reduced considerably (or even stopped) after receiving the signals to the control unit 210. Such flow condition may be maintained for a short time period, e.g., for as long as about 15 minutes. The electronics unit 330 interprets the signals and causes the solenoid 410 and the shaft 412 to move away from the valve seat 420, thereby removing the sealing engagement between the plunger 414 and the valve seat 420. Fluid may then flow through the filter 460, the valve seat 420 (now unobstructed), the flow tube 470, and the channel 234. As the fluid enters the first chamber 236, the fluid causes the first piston 242 and the sleeve 240 to move such that the sleeve 240 uncovers the openings 232 in the mandrel 230. The openings 232 in the mandrel 230 become aligned with the openings 244 in the first piston 242 so that fluid flows from the bore 238 in the mandrel 230 through the openings 232, 244 and into the second chamber 250. The fluid flowing into the second chamber 250 causes the second piston 252 to move the drive ring 254. The drive ring 254 moves the cutter blocks 220 axially toward the first end portion 202 of the body 200 and radially-outward, thereby transitioning the second underreamer 128 in the active state.

Once the second underreamer 128 is in the active state, the drill pipe 110 may move the bottom hole assembly 100 away from the surface (e.g., downward, as shown by arrow 148). As the second underreamer 128 moves downward, the cutter blocks 220 (now expanded radially-outward) cut or grind the wall of the wellbore 102 to increase the diameter of the second portion 152 of the wellbore 102 from the first diameter 140 to a third diameter 144, as shown in FIG. 14. The first underreamer 116 may be in the inactive state while the second underreamer 128 moves downward (as shown in FIG. 14), or the first underreamer 116 may be in the active state to act as a stabilizer (not shown).

The third diameter 144 may range from a low of about 10 cm, about 15 cm, or about 20 cm to a high of about 30 cm, about 40 cm, about 50 cm, or more. For example, the third diameter 144 may be from about 10 cm to about 20 cm, from about 15 cm to about 25 cm, from about 20 cm to about 30 cm, from about 25 cm to about 35 cm, from about 30 cm to about 40 cm, or more. A ratio of the second and/or third diameters 142, 144 to the first diameter 140 may be between about 1.05:1 and about 1.15:1, between about 1.1:1 and about 1.2:1, between about 1.15:1 and about 1.25:1, between about 1.2:1 and about 1.3:1, between about 1.25:1 and about 1.35:1, between about 1.3:1 and about 1.5:1, or more. As shown, the second and third diameters 142, 144 are the same; however, in another embodiment, they may be different.

After the second underreamer 128 has increased the diameter of the second portion 152 of the wellbore 102, the second underreamer 128 may be actuated into the inactive state. To actuate the second underreamer 128 back to the inactive state, one or more signals are sent down the wellbore 102 from the surface and received by the sensor 310. The electronics unit 330 interprets the signals and causes the solenoid 410 and the shaft 412 to move back toward from the valve seat 420 such that the plunger 414 sealingly engages with valve seat 420, thereby preventing fluid flow through the valve seat 420 and the flow tube 470.

With the fluid flow to the channel 234 and the first chamber 236 cut off, the force exerted by the compressed spring 246 overcomes the force exerted by the (now decreasing) pressure in the first chamber 236. This causes the first piston 242 and the sleeve 240 to move toward the first end portion 202 of the body 200 such that the sleeve 240 blocks fluid flow through the openings 232 in the mandrel 230. With the fluid flow to the second chamber 250 cut off, the force exerted by the compressed spring 260 (see FIG. 10) overcomes the force exerted by the (now decreasing) pressure in the second chamber 250. This causes a compressed spring 260 and a stop ring 262 (see FIG. 10) to move the cutter blocks 220 axially toward the second end portion 204 of the body 200 and radially-inward, thereby transitioning the second underreamer 128 back into the inactive state.

Figure 15:
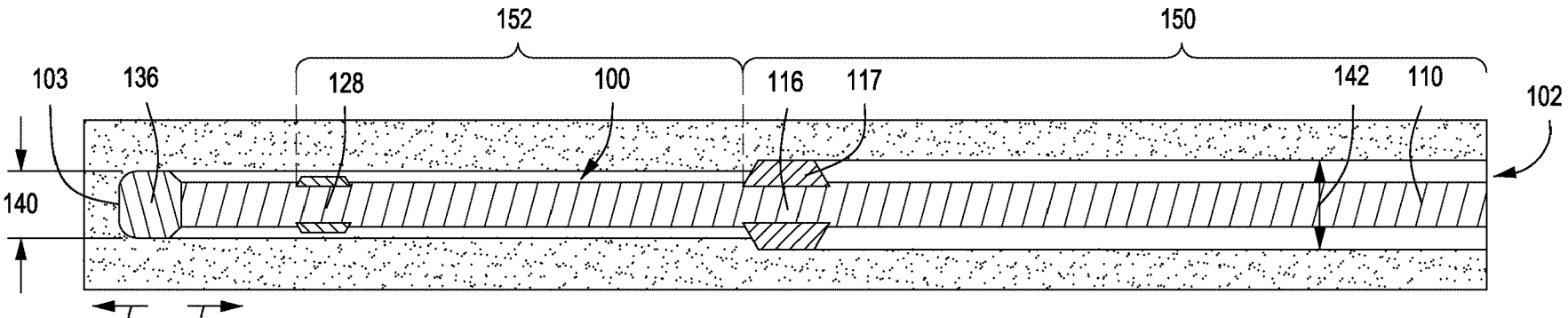
FIGS. 15, 16 and 17 depict another illustrative sequence of the first and second underreamers for increasing the diameter of the wellbore, according to one or more embodiments disclosed.
Figure 16:
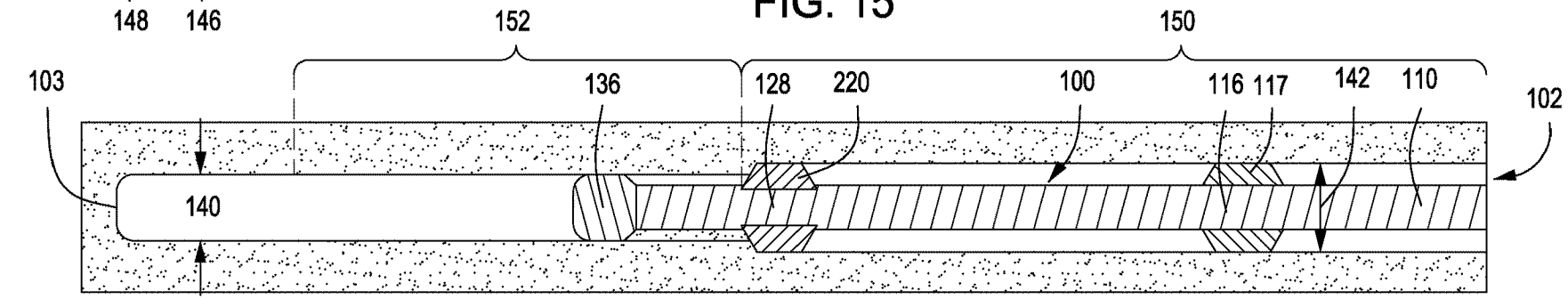
Figure 17:
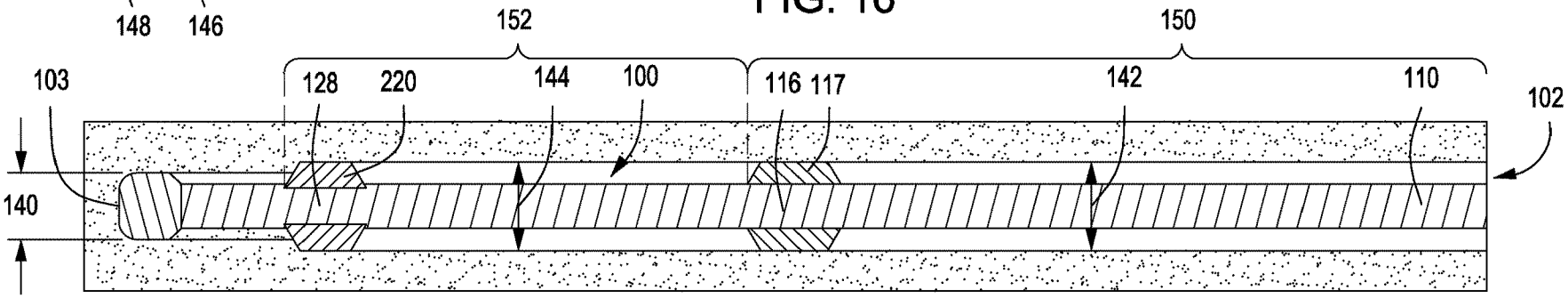

FIGS. 15-17 depict another illustrative sequence of the first and second underreamers 116, 128 for increasing the diameter of the wellbore 102, according to one or more embodiments. The first underreamer 116 may be in the active state as the drill bit 136 drills the wellbore 102 to the first diameter 140. This is referred to as one-pass underreaming, underreaming-while-drilling, or hole enlargement while drilling ("HEWD"). The second underreamer 128 may be in the inactive state during this initial drilling phase. Once the drill bit 136 reaches the desired depth, as shown in FIG. 15, the first portion 150 of the wellbore 102 has the second diameter 142, and the second portion 152 of the wellbore 102 has the first diameter 140.

The flow of fluid through the bottom hole assembly 100 may be reduced or stopped, and the drill pipe 110 may pull the bottom hole assembly 100 toward the surface (i.e., upward, as shown by arrow 146) until the second underreamer 128 is positioned in the first portion 150 of the wellbore 102, as shown in FIG. 16. The second underreamer 128 may then be actuated into the active state, as described above. The drill pipe 110 may then lower the bottom hole assembly 100 in the wellbore 102 in the direction 148. As the second underreamer 128 moves downward, the cutter blocks 220 (now expanded radially-outward) cut or grind the wall of the wellbore 102 to increase the diameter of the second portion 152 of the wellbore 102 from the first diameter 140 to the third diameter 144, as shown in FIG. 17. The first underreamer 116 may be in the inactive state while the second underreamer 128 moves downward, or the first underreamer 116 may be in the active state to act as a stabilizer. The second underreamer 128 may then be actuated into the inactive state, as described above.

Figure 18:
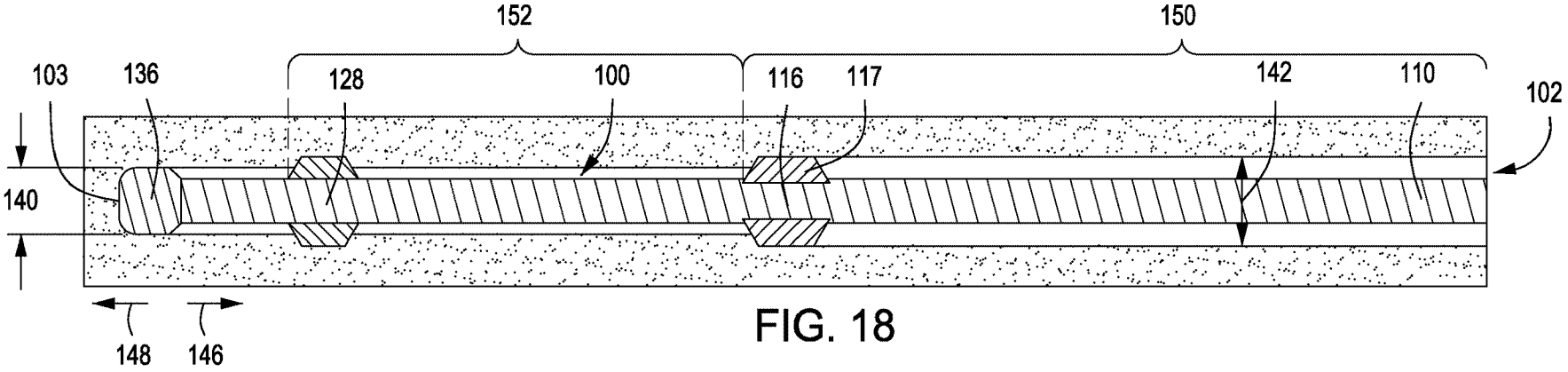
FIGS. 18 and 19 depict another illustrative sequence of the first and second underreamers for increasing the diameter of the wellbore, according to one or more embodiments disclosed.
Figure 19:
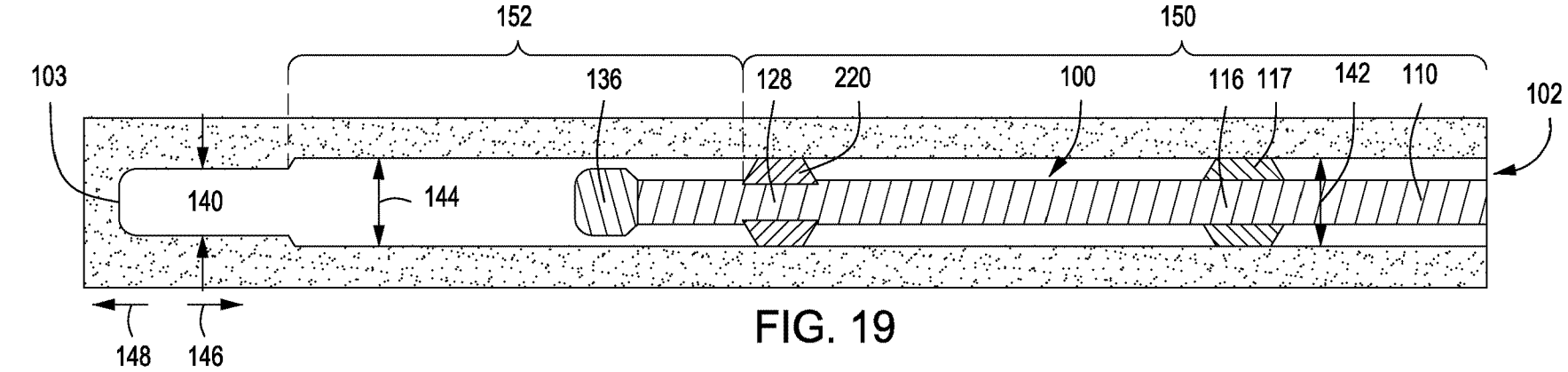

FIGS. 18 and 19 depict another illustrative sequence of the first and second underreamers 116, 128 for increasing the diameter of the wellbore 102, according to one or more embodiments. Similar to the second sequence described above, the first underreamer 116 may be in the active state as the drill bit 136 drills the wellbore 102 to the first diameter 140. The second underreamer 128 may be in the inactive state during this initial drilling phase. Once the drill bit 136 reaches the desired depth, as shown in FIG. 15, the first portion 150 of the wellbore 102 has the second diameter 142, and the second portion 152 of the wellbore 102 has the first diameter 140.

Rather than raising the second underreamer 128 into the first portion 150 of the wellbore 102 prior to actuating the second underreamer 128, as in the second sequence, the second underreamer 128 may be actuated into the active state while disposed in the second portion 152 of the wellbore 102. For example, the second underreamer 128 may be actuated into the active state when the drill bit 136 is positioned proximate the base 103 of the wellbore 102, as shown in FIG. 18.

The drill pipe 110 may then raise the bottom hole assembly 100 in the wellbore 102 in the direction 146. As the second underreamer 128 moves upward, the cutter blocks 220 (now expanded radially-outward) cut or grind the wall of the wellbore 102 to increase the diameter of the second portion 152 of the wellbore 102 from the first diameter 140 to the third diameter 144, as shown in FIG. 19. The first underreamer 116 may be in the inactive state while the second underreamer 128 moves upward, or the first underreamer 116 may be in the active state to act as a stabilizer. The second underreamer 128 may then be actuated into the inactive state, as described above.

Figure 20:
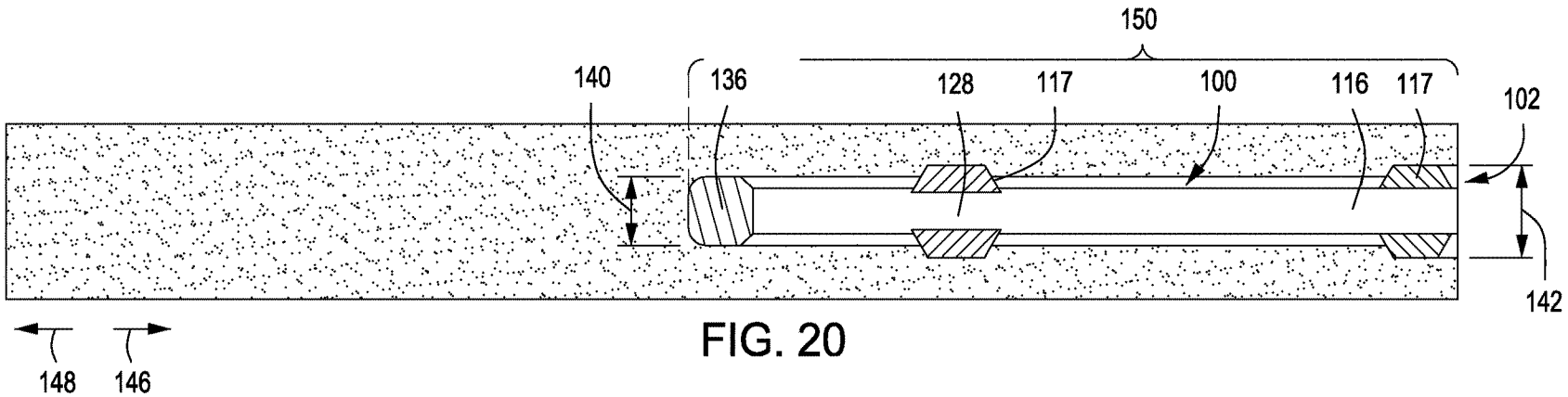
FIGS. 20 and 21 depict yet another illustrative sequence of the first and second underreamers for increasing the diameter of the wellbore, according to one or more embodiments disclosed.
Figure 21:
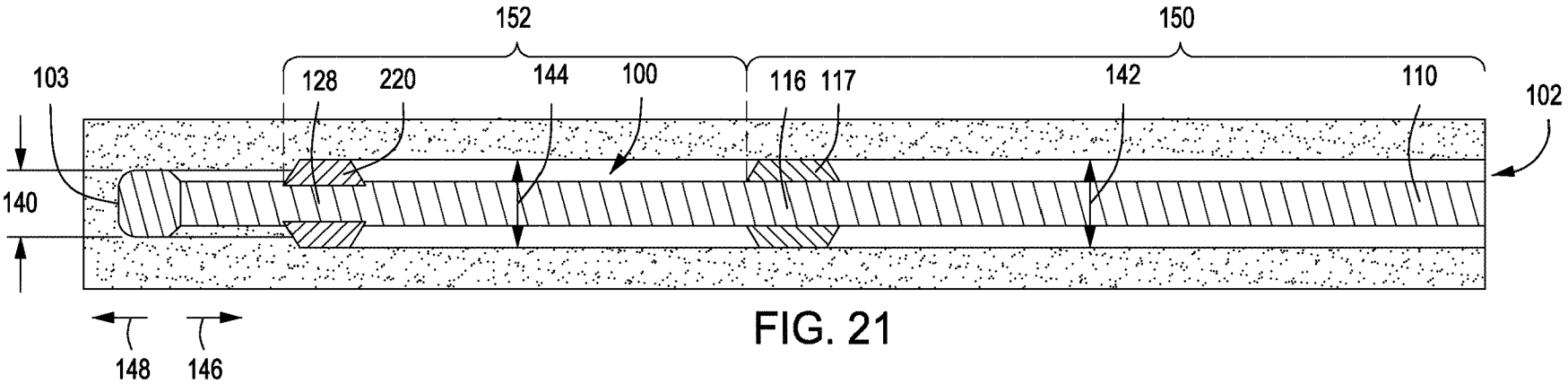

FIGS. 20 and 21 depict another illustrative sequence of the first and second underreamers 116, 128 for increasing the diameter of the wellbore 102, according to one or more embodiments. The first underreamer 116 may be in the active state as the drill bit 136 drills the wellbore 102 to the first diameter 140. The second underreamer 128 may be in the inactive state during this initial drilling phase. When the drill bit 136 is a predetermined distance from the desired depth of the wellbore 102, the second underreamer 128 may be actuated into the active state, as shown in FIG. 20. The distance may be about 1 m to about 5 m, about 5 m to about 10 m, about 10 m to about 25 m, about 25 m to about 50 m, about 50 m to about 100 m, or more. The distance from the desired depth may be greater than the distance between the first and second underreamers 116, 128.

The drill pipe 110 may then lower the bottom hole assembly 100 in the wellbore 102 in direction 148. As the second underreamer 128 moves downward, the cutter blocks 220 (now expanded radially-outward) cut or grind the wall of the wellbore 102 to increase the diameter of the second portion 152 of the wellbore 102 from the first diameter 140 to the third diameter 144 while the drill bit 136 drills, as shown in FIG. 21. The first underreamer 116 may remain in the active state while the second underreamer 128 moves downward. After the drill bit 136 reaches the desired depth, the first and second underreamers 116, 128 may be actuated into the inactive state.

In the drill string, several tools may be equipped with a sensing system or sensor to detect signals sent to the downhole tools via the wellbore or surrounding formation. These tools may be designed to detect similar signals based on the same physics, such as flow and/or pressure fluctuation, current in the drill string or the surrounding formation, and/or acoustic signals. The transmitted signal may be sufficiently different so that one of the downhole tools may identify an "acceptable" signal for its own processing. This downhole tool may then take the proper action. The signal differentiation may be based on amplitude, amplitude variation, timing of variations of the amplitude, frequency content of the signal, and/or digital pattern of variation of the amplitude.

The tools which may be simultaneously in the drill string and capable to detect transmitted signal may be the MWD 120, the RSS, first underreamer 116, the second underreamer 128, a diverting valve, a whipstock, a variable gauge stabilizer, a jar (for its locking and un-locking), or any other mechanical tools which may use downhole activation.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although only a few example embodiments have been described in detail above, those skilled in the art will readily appreciate that many modifications are possible in the example embodiments without materially departing from "Underreamer for Increasing a Wellbore Diameter." Accordingly, all such modifications are intended to be included within the scope of this disclosure. Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. An underreamer for increasing a diameter of a wellbore, comprising:

a body having an axial bore;

an electrical motor at least partially within the body;

a valve within the axial bore and coupled to the electrical motor, the valve including a rotor with a first opening therethrough and a stator with a second opening therethrough, the rotor being coupled to the electrical motor and configured to move from a first position where fluid flow from outside the valve and through the first opening to a flow tube is obstructed by the stator to a second position where the first and second openings are aligned and flow from outside the valve and through the first opening to the flow tube is permitted; and a cutting element movably coupled to the body and configured to move radially as the rotor moves between the first and second positions.

2. The underreamer of claim 1, the rotor and the stator each being annular, and the first and second openings being radial openings.

3. The underreamer of claim 1, the first and second openings being axial openings.

4. The underreamer of claim 1, the first opening including a plurality of circumferentially offset openings.

5. The underreamer of claim 1, the rotor being configured to rotate when a flow rate of fluid through the axial bore is less than a predetermined level, and the rotor being prevented from rotating when the flow rate is greater than the predetermined level.

6. The underreamer of claim 1, further comprising:

a fluid pressure-activated locking mechanism configured to prevent the movement of the rotor relative to the stator.

7. The underreamer of claim 6, the locking mechanism preventing the rotor from rotating when a pressure of a fluid in the bore is greater than a pressure of a fluid in an annulus radially-outward from the body.

8. The underreamer of claim 1, comprising an electromagnetic activation system having the electrical motor and a solenoid with a mobile element, the rotor being in the first position when a poppet of the mobile element coupled to the solenoid is seated against a valve seat, and the rotor being in the second position when the poppet is not seated against the valve seat.

9. A downhole tool, comprising:

a body defining an axial bore;

a control unit within the axial bore, the control unit including:

a control system adapted to process a signal;

an activation system coupled to the control system and adapted to move in response to the control system processing the signal; and a valve within the axial bore and coupled to the activation system, the valve having a first configuration obstructing fluid flow through the valve and a second configuration allowing fluid flow through the valve; and a flow tube coupled to the valve and adapted to have fluid flow therethrough when the valve is in the second configuration, the fluid flowing along a radially inward path from the axial bore, through the valve, and into the flow tube.

10. The downhole tool of claim 9, further comprising:

a cutting tool movably coupled to the body and configured to move from a radially inward position when the valve is in the first configuration to a radially extended position when the valve is in the second configuration.

11. The downhole tool of claim 9, further comprising a sensor in communication with the control system and adapted to receive a wireless signal via flow variation or pressure variation in the body or an annulus around the body.

12. The downhole tool of claim 9, further comprising:

a mandrel coupled to the flow tube, the mandrel having a first opening formed radially therethrough in fluid communication with the flow tube, the mandrel also having a second opening formed radially therethrough; and a sleeve at least partially around the mandrel and adapted to move axially with respect to the mandrel from a first position to a second position when the fluid flows through the flow tube and the first opening in the mandrel, the sleeve blocking fluid flow through the second opening in the mandrel when in the first position, and the sleeve allowing fluid flow through the second opening in the mandrel when in the second position.

13. The downhole tool of claim 12, the sleeve being configured to be in the first position when the valve is in the first configuration, and the sleeve being configured to move to the second position when the valve is in the second configuration.

14. A downhole tool, comprising:

a body;

a mandrel within the body, the mandrel having a port fluidly coupled to a channel;

a reciprocating body within the body of the downhole tool and configured to move axially between first and second positions with respect to the mandrel, the reciprocating body blocking fluid flow through the port when in the first position and the reciprocating body allowing fluid flow through the port when in the second position;

a piston within the body of the downhole tool and a chamber being defined between the piston and the mandrel, the piston including a port configured to align with the port of the mandrel when the reciprocating body is in the second position, the channel of the mandrel allowing a radially inward and axially downward flow a path of fluid communication to the chamber; and a plurality of expandable elements movably coupled to the body and configured to move from a radially inward position when the reciprocating body is in the first position to a radially outward position when the reciprocating body is in the second position.

15. The downhole tool of claim 14, the piston being configured to move the reciprocating body from the first position to the second position when the fluid flows radially inward and axially downward, then though the channel, and into the chamber.

16. The downhole tool of claim 14, further comprising first and second seals between the piston and the mandrel, the chamber being axially between the first and second seals.

17. The downhole tool of claim 14, further comprising first and second seals between the reciprocating body and the mandrel, the port of the mandrel being axially between the first and second seals when the reciprocating body is in the first position.

18. The downhole tool of claim 14, the port of the mandrel including a plurality of radial ports that are circumferentially offset from one another.

19. The downhole tool of claim 14, further comprising a spring between the mandrel and the body, the spring being compressed when the reciprocating body moves from the first position to the second position.

20. The downhole tool of claim 14, further comprising an electrical or electromechanical control unit that controls movement of the reciprocating body based on wireless signals.

* * * * *